US009542923B1

(12) United States Patent
Shigeno

(10) Patent No.: US 9,542,923 B1
(45) Date of Patent: Jan. 10, 2017

(54) MUSIC SYNTHESIZER

(71) Applicant: ROLAND CORPORATION, Shizuoka (JP)

(72) Inventor: Yukio Shigeno, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 0 days.

(21) Appl. No.: 14/869,936

(22) Filed: Sep. 29, 2015

(51) Int. Cl.
*G10H 1/06* (2006.01)
*G10H 7/00* (2006.01)

(52) U.S. Cl.
CPC ..... *G10H 7/00* (2013.01); *G10H 2250/541* (2013.01)

(58) Field of Classification Search
CPC ..... G10H 1/0058; G10H 2240/071; G10H 2240/165; G10H 2210/066; G10H 1/12; G10H 2250/615; G10H 2210/331; G10H 5/07; G10H 2250/571; G10H 2250/621; G10H 2250/535; G10L 19/02; G10L 25/90; G10L 19/005; G10L 19/06; G10D 17/00
See application file for complete search history.

(56) References Cited

U.S. PATENT DOCUMENTS 5,597,970 A * 1/1997 Sato ..... G10H 1/125 84/604
5,763,803 A * 6/1998 Hoshiai ..... G10H 1/0091 84/626
6,392,135 B1 * 5/2002 Kitayama ..... G10H 1/0575 84/622
7,149,682 B2 * 12/2006 Yoshioka ..... G10L 13/033 704/205
2005/0120870 A1 * 6/2005 Ludwig ..... G10H 1/00 84/661
2005/0132870 A1 * 6/2005 Sakurai ..... G10H 1/125 84/612
2007/0107585 A1 * 5/2007 Leahy ..... G06Q 50/10 84/616
2014/0000440 A1 * 1/2014 Georges ..... G10H 7/00 84/609

FOREIGN PATENT DOCUMENTS

JP 09-006351 1/1997

OTHER PUBLICATIONS

Musikmesse 2015: BOSS SY-300, http://www.sweetwater.com/insync/musikmesse-2015-boss-sy-300/, retrieved on Sep. 9, 2015, "Musikmesse 2015: BOSS SY-300".
Roland—Company—Press Releases—BOSS Unveils SY-300 Guitar Synthesizer, http://www.rolandus.com/company/press_releases/30146, retrieved on Sep. 25, 2015, "BOSS Unveils SY-300 Guitar Synthesizer".

(Continued)

*Primary Examiner* — Marlon Fletcher
(74) *Attorney, Agent, or Firm* — Jianq Chyun IP Office

(57) ABSTRACT

A music synthesizer is provided. The synthesizer divides an input sound into a plurality of musical bands, and, for each divided band, generates a waveform having a predetermined shape with a period corresponding to a detected pitch and with a level corresponding to a detected level. The synthesizer then adds up the waveforms generated for each band and outputs a result thereof.

16 Claims, 20 Drawing Sheets

(56) References Cited

OTHER PUBLICATIONS cms2.rolandus.com, http://cms2.rolandus.com/assets/media/pdf/pr_2015-04-15_sy-300.pdf, which is a press release of SY-300 dated on Apr. 15, 2015, the link of which is embedded on the above-listed http://www.rolandus.com/company/press_releases/30146, retrieved on Sep. 25, 2015, "BOSS Unveils SY-300 Guitar Synthesizer".

* cited by examiner

61

| |
|---|
| band_level_00 |
| band_level_01 |
| band_level_02 |
| ⋮ |
| band_level_46 |
| band_level_47 |
| band_level_48 |

FIG. 6A

62

| |
|---|
| parameter_A_cutoff |
| parameter_A_dynamics |
| parameter_B_cutoff |
| parameter_B_dynamics |

FIG. 6B

71

| |
|---|
| band_frequency_00 |
| band_frequency_01 |
| band_frequency_02 |
| ⋮ |
| band_frequency_46 |
| band_frequency_47 |
| band_frequency_48 |

72

| | |
|---|---|
| wg_A00_sin_level<br>wg_A00_saw_level<br>wg_A00_sqr_level<br>wg_A00_level | tone_A_pitch<br>tone_A_cutoff<br>tone_A_resonance<br>tone_A_level |
| wg_A01_sin_level<br>wg_A01_saw_level<br>wg_A01_sqr_level<br>wg_A01_level | |
| wg_A02_sin_level<br>wg_A02_saw_level<br>wg_A02_sqr_level<br>wg_A02_level | |
| ⋮ | |
| wg_A46_sin_level<br>wg_A46_saw_level<br>wg_A46_sqr_level<br>wg_A46_level | |
| wg_A47_sin_level<br>wg_A47_saw_level<br>wg_A47_sqr_level<br>wg_A47_level | |
| wg_A48_sin_level<br>wg_A48_saw_level<br>wg_A48_sqr_level<br>wg_A48_level | |

73

| | |
|---|---|
| wg_B00_sin_level<br>wg_B00_saw_level<br>wg_B00_sqr_level<br>wg_B00_level | tone_B_pitch<br>tone_B_cutoff<br>tone_B_resonance<br>tone_B_level |
| wg_B01_sin_level<br>wg_B01_saw_level<br>wg_B01_sqr_level<br>wg_B01_level | |
| wg_B02_sin_level<br>wg_B02_saw_level<br>wg_B02_sqr_level<br>wg_B02_level | |
| ⋮ | |
| wg_B46_sin_level<br>wg_B46_saw_level<br>wg_B46_sqr_level<br>wg_B46_level | |
| wg_B47_sin_level<br>wg_B47_saw_level<br>wg_B47_sqr_level<br>wg_B47_level | |
| wg_B48_sin_level<br>wg_B48_saw_level<br>wg_B48_sqr_level<br>wg_B48_level | |

FIG. 7

| | |
|---|---|
| band_frequency_00 | E2(82.4Hz) |
| band_frequency_01 | F2(87.3Hz) |
| band_frequency_02 | F#2(92.5Hz) |
| ⋮ | ⋮ |
| band_frequency_46 | D6(1174.7Hz) |
| band_frequency_47 | D#6(1244.5Hz) |
| band_frequency_48 | E6(1318.5Hz) |

| | |
|---|---|
| band_frequency_00 | E1(41.2Hz) |
| band_frequency_01 | F1(43.7Hz) |
| band_frequency_02 | F#1(46.2Hz) |
| ⋮ | ⋮ |
| band_frequency_46 | D5(587.3Hz) |
| band_frequency_47 | D#5(622.3Hz) |
| band_frequency_48 | E5(659.3Hz) |

SIN

| | |
|---|---|
| wg_A00_sin_level | 1.0 |
| wg_A01_sin_level | |
| wg_A02_sin_level | |
| ⋮ | |
| wg_A46_sin_level | |
| wg_A47_sin_level | |
| wg_A48_sin_level | |
| wg_A00_saw_level | 0.0 |
| wg_A01_saw_level | |
| wg_A02_saw_level | |
| ⋮ | |
| wg_A46_saw_level | |
| wg_A47_saw_level | |
| wg_A48_saw_level | |
| wg_A00_sqr_level | 0.0 |
| wg_A01_sqr_level | |
| wg_A02_sqr_level | |
| ⋮ | |
| wg_A46_sqr_level | |
| wg_A47_sqr_level | |
| wg_A48_sqr_level | |

FIG. 11A

SAW

| | |
|---|---|
| wg_A00_sin_level | 0.0 |
| wg_A01_sin_level | |
| wg_A02_sin_level | |
| ⋮ | |
| wg_A46_sin_level | |
| wg_A47_sin_level | |
| wg_A48_sin_level | |
| wg_A00_saw_level | 1.0 |
| wg_A01_saw_level | |
| wg_A02_saw_level | |
| ⋮ | |
| wg_A46_saw_level | |
| wg_A47_saw_level | |
| wg_A48_saw_level | |
| wg_A00_sqr_level | 0.0 |
| wg_A01_sqr_level | |
| wg_A02_sqr_level | |
| ⋮ | |
| wg_A46_sqr_level | |
| wg_A47_sqr_level | |
| wg_A48_sqr_level | |

FIG. 11B

SQR

| | |
|---|---|
| wg_A00_sin_level | 0.0 |
| wg_A01_sin_level | |
| wg_A02_sin_level | |
| ⋮ | |
| wg_A46_sin_level | |
| wg_A47_sin_level | |
| wg_A48_sin_level | |
| wg_A00_saw_level | 0.0 |
| wg_A01_saw_level | |
| wg_A02_saw_level | |
| ⋮ | |
| wg_A46_saw_level | |
| wg_A47_saw_level | |
| wg_A48_saw_level | |
| wg_A00_sqr_level | 1.0 |
| wg_A01_sqr_level | |
| wg_A02_sqr_level | |
| ⋮ | |
| wg_A46_sqr_level | |
| wg_A47_sqr_level | |
| wg_A48_sqr_level | |

FIG. 11C

SAW-SQR

| | |
|---|---|
| wg_A00_sin_level | 0.0 |
| wg_A01_sin_level | |
| wg_A02_sin_level | |
| ⋮ | |
| wg_A46_sin_level | |
| wg_A47_sin_level | |
| wg_A48_sin_level | |
| wg_A00_saw_level | 48.0/48.0 |
| wg_A01_saw_level | 47.0/48.0 |
| wg_A02_saw_level | 46.0/48.0 |
| ⋮ | ⋮ |
| wg_A46_saw_level | 2.0/48.0 |
| wg_A47_saw_level | 1.0/48.0 |
| wg_A48_saw_level | 0.0/48.0 |
| wg_A00_sqr_level | 0.0/48.0 |
| wg_A01_sqr_level | 1.0/48.0 |
| wg_A02_sqr_level | 2.0/48.0 |
| ⋮ | ⋮ |
| wg_A46_sqr_level | 46.0/48.0 |
| wg_A47_sqr_level | 47.0/48.0 |
| wg_A48_sqr_level | 48.0/48.0 |

FIG. 11D

MUSIC SYNTHESIZER

BACKGROUND OF THE INVENTION

Field of the Invention

The invention relates to a music synthesizer.

Related Art

FIG. 21 is a block diagram showing a configuration of a conventional synthesizer. The synthesizer shown in FIG. 21 receives an input of a guitar sound or a microphone sound and thereby produces a synthesizer sound corresponding to the input sound. The synthesizer includes a pitch detector 211, a gate detector 212 and a waveform generating means 213.

The pitch detector 211 detects a frequency (pitch) of the input sound and outputs information (hereinafter "pitch information") of the detected pitch. The gate detector 212 compares a signal level of the input sound with a predetermined threshold value and thereby detects presence or absence of the input sound. The gate detector 212 outputs gate-ON information when detecting the input sound, and outputs gate-OFF information when no longer detecting the input sound.

The waveform generating means 213 includes a sound source (sounding body) for producing the synthesizer sound. The waveform generating means 213 produces, as the synthesizer sound, sounds of various waveforms (e.g., sine wave, sawtooth wave and square wave, etc.) corresponding to parameters set by a parameter setting means (not illustrated).

When the gate-ON information is received from the gate detector 212, the waveform generating means 213 starts to produce the synthesizer sound, and during the production of the synthesizer sound, the waveform generating means 213 controls the frequency of the synthesizer sound to be a frequency corresponding to the pitch information received from the pitch detector 211. Then, when the gate-OFF information is received from the gate detector 212, the waveform generating means 213 muffles the synthesizer sound.

FIG. 22 is a block diagram showing a configuration of another conventional synthesizer. The synthesizer shown in FIG. 22 is, e.g., the synthesizer described in Patent Document 1 (JPH09-006351 A), so-called a polyphonic guitar synthesizer. This synthesizer is capable of producing a synthesizer sound individually not only when a single note is played but also when a plurality of strings are played at the same time (i.e., even when a chord is played).

As shown in FIG. 22, the synthesizer includes six strings 221 stretched on a guitar, a pickup 222, a pitch detector 223, a gate detector 224, a waveform generating means 225 and a mixer 226. The pickup 222 converts vibration of the string 221 into an electrical signal. The pickup 222 is independently provided for each of the six strings 221 and is capable of picking out the vibration of each string 221 as an electrical signal individually.

The pitch detector 223 is a detector similar to the pitch detector 211 and is provided corresponding to each of the six strings 221. The gate detector 224 is a detector similar to the gate detector 212 and is provided corresponding to each of the six strings 221. The waveform generating means 225 is a waveform generating means similar to the waveform generating means 213 and is provided corresponding to each of the six strings 221. The mixer 226 adds up outputs from each waveform generating means 225 corresponding to each string 221 and outputs a result thereof.

(1) Issue Relating to Timbre of Synthesizer Sound

In the aforementioned conventional synthesizer, whether the type of the input sound is a guitar sound or a microphone sound such as a singing voice, the pitch detector outputs one piece of pitch information for one input sound, and the waveform generating means outputs the synthesizer sound at a frequency corresponding to the pitch information. In other words, whether a guitar produces a sound having a pitch name "Do" or a singer sings a note having a pitch name "Do," the pitch detector will detect the same pitch name "Do." This means that a synthesizer sound outputted according to a detected pitch will have the same timbre regardless of the type of the input sound.

Therefore, although guitar sound and singing voice have completely different timbres, a synthesizer sound outputted for the same pitch name will have the same timbre without making use of the characteristics of the guitar sound or the singing voice. As a result, the timbre of the synthesizer sound becomes monotonous.

Moreover, the reason why timbre varies according to the type of sound such as guitar sound or singing voice is that harmonic components contained in that sound vary. A harmonic refers to a sound having a frequency that is an integral multiple of (e.g., twice, triple, etc.) the frequency of a fundamental pitch sound (hereinafter "fundamental tone"). According to how the harmonics are contained as components of a sound, characteristics are imparted to the timbre of that sound. The conventional synthesizer does not collect such timbre characteristics as information from the input sound, but merely acquires the information of one pitch as a representative value.

(2) Issue Relating to Gate Detection

In the conventional synthesizer, the gate detector is used to output the gate-ON information when the input sound is detected, and to output the gate-OFF information when the input sound is no longer detected. However, because level variation of an actual sound or voice is complicated, the gate detector sometimes performs detection different from that intended by the performer or the singer, i.e., erroneous detection.

FIG. 23 shows an example of erroneous detection performed by the gate detector. In the example shown in FIG. 23, an input sound 231 is inputted as a series of sounds (sounds that are continuous without being interrupted halfway). A broken line 232 indicates transition in level obtained from the input sound 231. The level of the input sound 231 is temporarily lower than a threshold value 233 at halfway time T1. The gate detector outputs the gate-OFF information as the level of the input sound 231 becomes lower than the threshold value 233.

Then, the level of the input sound 231 exceeds the threshold value 233 again at halfway time T2. Accordingly, the gate detector outputs the gate-ON information. As a result, the waveform generating means silences the synthesizer at time T1, and then resumes sound production at time T2. In other words, although the input sound 231 was inputted as a series of sounds, a synthesizer sound that is temporarily interrupted in the middle is produced. This is called erroneous detection in gate detection.

Regarding this, it may be considered to prevent the erroneous detection by reducing the threshold value. However, because of the reduction in the threshold value, the gate-OFF information and gate-ON information can be sensitively outputted even for a feeble signal. Accordingly, production of the synthesizer sound may even be initiated by, e.g., a noise-like signal. This is also erroneous detection in gate detection.

Alternatively, from the input sound, it may be considered to perform smoothing when acquiring the level of the input sound. In detail, in order to achieve a more gradual level variation, a moving average may be utilized, or a time constant that the level follows for an audio input is increased, so as to improve detection stability.

However, because of the more gradual level variation due to the smoothing, another problem occurs, namely, response in gate detection becomes poor. That is, time from input of a sound until output of the gate-ON information is increased. As for output of the gate-OFF information, the same problem occurs. The poor response in gate detection may cause poor response to a performance, and therefore becomes a main cause of an incompatible feeling for the performer.

In gate detection, in addition to the aforementioned erroneous detection problem, there is a problem that the synthesizer sound is monotonous. The synthesizer only starts sound production in response to the gate-ON information and is silenced in response to the gate-OFF information. As shown in FIG. 24A, the level of the produced synthesizer sound does not vary.

In contrast, as shown in FIG. 24B, at the start of production of the synthesizer sound, an envelope generator is used to control the level of the synthesizer sound according to a time-series level variation pattern (shown by the broken line 241) that was pre-programmed, thereby making it possible to obtain a synthesizer sound rich in level variation. However, the level variation controlled by the envelope generator has the same pattern for the gate-ON information every time. Hence, the synthesizer sound is even more monotonous in this respect.

(3) Issue Relating to Polyphonic Guitar Synthesizer

The aforementioned conventional polyphonic guitar synthesizer (in FIG. 22) includes the pitch detector 223, the gate detector 224, and the waveform generating means 225 of a plurality of systems in accordance with the number of strings stretched on the guitar. The configuration shown in FIG. 22 is specialized for an instrument called a six-string guitar, and enhancements will be necessary for adapting the configuration to guitars other than the six-string such as those with seven or eight strings. That is, since it is necessary to change the processing configuration (specifically, the numbers of the pitch detector, the gate detector and the waveform generating means) according to the number of strings, the polyphonic guitar synthesizer made for six-string guitars, for example, cannot be applied to the guitars other than the six-string without change.

In addition, according to various types of stringed instruments such as guitars or basses, it is necessary to change physical configuration (number of installation, or distance between pickups, etc.) of pickups. Therefore, in this respect, the polyphonic guitar synthesizer made for a certain type of stringed instrument cannot be applied to the other types of stringed instruments.

SUMMARY OF THE INVENTION

The invention is made in view of the aforementioned matters, and provides a general-purpose synthesizer capable of producing a suitable synthesizer sound. According to the synthesizer of one aspect of the invention, the synthesizer includes: a band dividing means that divides an input sound into a plurality of musical bands; a pitch detecting means that, for each band divided by the band dividing means, detects a pitch of a signal of the each band; a level detecting means that, for each band divided by the band dividing means, detects a level of the signal of the each band; a waveform generating means that, for each band divided by the band dividing means, generates a waveform having a predetermined shape according to the signal of the each band; a waveform period control means that, for each band divided by the band dividing means, controls a period of the waveform generated by the waveform generating means corresponding to the each band to be a period corresponding to the pitch detected by the pitch detecting means corresponding to the each band; a waveform level control means that, for each band divided by the band dividing means, controls a level of the waveform generated by the waveform generating means corresponding to the each band to be a level corresponding to the level detected by the level detecting means corresponding to the each band; and an adding means that adds up the waveforms generated by each of the waveform generating means corresponding to each band divided by the band dividing means and outputs a result thereof.

According to the synthesizer, the input sound is divided into a plurality of musical bands. For each divided band, a waveform having a predetermined shape is generated with a period corresponding to the detected pitch and with a level corresponding to the detected level. Then, the waveforms generated for each band are added up and outputted. Therefore, even when only one input sound is inputted, a synthesizer sound corresponding to the timbre of the input sound can be outputted. In other words, by division of the input sound into a plurality of bands, not only fundamental pitch sounds (fundamental tones) but also harmonic components can be detected. Thus, a rich synthesizer sound that reflects the harmonic components contained in the input sound, i.e., reflects the timbre of the input sound, can be outputted.

In addition, according to the synthesizer, since a waveform generation level is controlled by the waveform level control means according to the level of each band in the input sound, the rich (i.e., not monotonous) level variation inherent in the input sound can be reflected in the synthesizer sound. In this respect, a rich synthesizer sound can be outputted.

Furthermore, according to the synthesizer, since the waveform generation level is controlled by the waveform level control means according to the level of each band in the input sound, there is no need to perform a sound production control using gate detection as in the prior art. Accordingly, the problems caused by the gate detection can be avoided, and the synthesizer sound that complies with the intention of the input sound can be outputted.

In addition, according to the synthesizer, since the input sound is divided into a plurality of bands so as to obtain the synthesizer sound for the input sound, a polyphonic guitar synthesizer can be realized without installing a pickup corresponding to each string. In addition, there is no need to change the processing configuration according to the number of strings or the type of the stringed instrument, and a program does not change according to difference in the number of strings. Therefore, the synthesizer can be utilized independently of the number of strings or the type of the stringed instrument such as a guitar or a bass.

In the synthesizer, a plurality of types of band division information defining the mode of the band dividing means dividing the input sound into a plurality of musical bands is stored in a memory means. From among the band division information stored in the memory means, the band division information is specified by a band division information specifying means. Based on the specified band division information, a band setting means sets how the band dividing means divides the input sound into a plurality of musical bands.

Accordingly, the mode of the band dividing means dividing the input sound into a plurality of musical bands can be properly changed. Therefore, for various instruments that produce sounds in various frequency ranges, there is no need to provide a large number of bands in order to cover a wide frequency range for comprehensively corresponding to all the instruments, and a plurality of types of instruments can be properly handled by a limited number of bands. Thus, manufacturing cost of the synthesizer can be reduced.

Particularly, a plurality of the band division information corresponding to a plurality of types of instruments is stored in the memory means. Thus, by specifying a certain instrument from among the plurality of types of instruments, a synthesizer sound suitably corresponding to an input sound from the instrument can be generated.

In the synthesizer, a filter process performed by a filter means is applied to the waveform obtained through the addition performed by the adding means. Filter characteristics used in such filter process are controlled by a filter characteristic control means and are changed based on the level detected by the level detecting means corresponding to each band. Therefore, since a synthesizer sound processed according to the level of the input sound can be outputted, the synthesizer sound can avoid becoming monotonous.

In the synthesizer, the period of the waveform generated by the waveform generating means corresponding to each band is controlled to be a period corresponding to a value obtained by adding a pitch shift amount set by a pitch shift amount setting means to the pitch detected by the pitch detecting means corresponding to the each band. Therefore, since the synthesizer sound generated from the input sound can be given variety corresponding to the pitch shift amount, the synthesizer sound can avoid becoming monotonous.

In the synthesizer, the period of the waveform generated by the waveform generating means corresponding to each band is controlled to be a period corresponding to a value obtained by adding a low-frequency periodic signal outputted from a periodic signal output means to the pitch detected by the pitch detecting means corresponding to the each band. Accordingly, the pitch of the synthesizer sound can be periodically shifted up and down according to the periodic signal outputted by the periodic signal output means. Therefore, since a vibrato effect can be imparted to the synthesizer sound, the synthesizer sound can avoid becoming monotonous.

BRIEF DESCRIPTION OF THE DRAWINGS

FIGS. 6A and 6B illustrate information stored in a RAM.

FIG. 7 illustrates the information stored in the RAM.

FIGS. 11A to 11D respectively show lists of parameter information to be written when an operating element WAVEFORM is set to SIN, SAW, SQR and SAW-SQR.

DESCRIPTION OF EXEMPLARY EMBODIMENTS

Preferred embodiments of the invention are described hereinafter with reference to the accompanying drawings. First, a first embodiment of the invention is described with reference to FIGS. 1 to 15.

[Form of Utilizing the Device]

Figure 1:
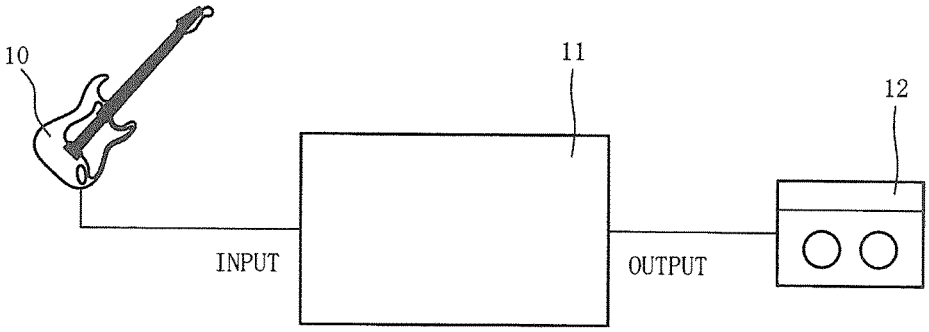
FIG. 1 is a schematic diagram showing an example of form of utilizing a device of the invention.

FIG. 1 is a schematic diagram showing an example of form of utilizing a device of the invention. A device 11 of the invention is a synthesizer generating a synthesizer sound from a guitar sound or a bass sound. The device 11 (hereinafter "synthesizer 11") is utilized by connecting a stringed instrument 10 being a guitar or a bass to an INPUT terminal and connecting an amplifier 12 to an OUTPUT terminal.

More specifically, when a sound of playing the stringed instrument 10 is inputted as an input sound via the INPUT terminal, the synthesizer 11 generates a synthesizer sound based on the input sound, and outputs the synthesizer sound to the amplifier 12 via the OUTPUT terminal. Accordingly, the synthesizer sound generated based on the input sound from the stringed instrument 10 is emitted from the amplifier 12.

[Device Configuration]

Figure 2:
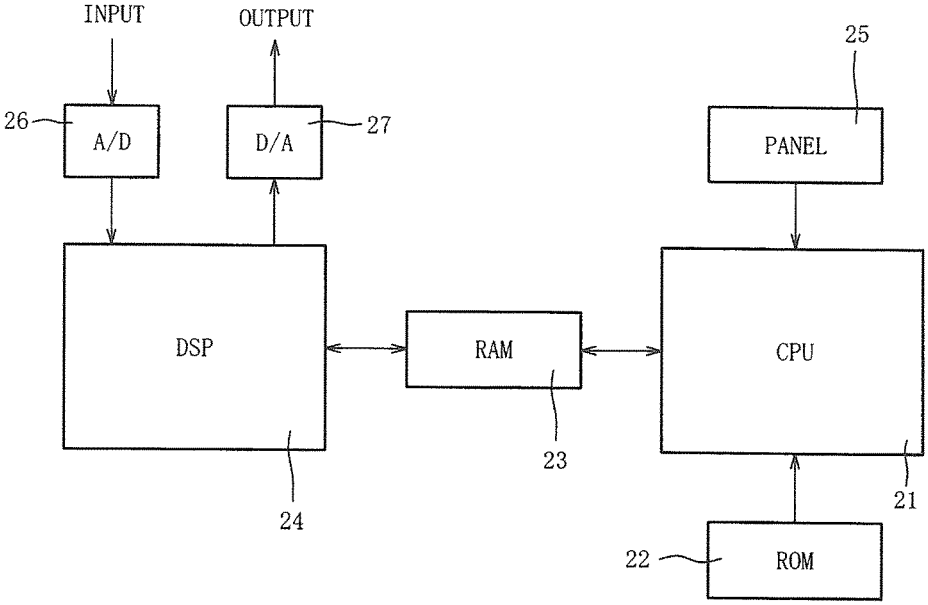
FIG. 2 is a block diagram showing a configuration of the device of the invention.

FIG. 2 is a block diagram showing a configuration of the synthesizer 11 being the device of the invention. The synthesizer 11 includes: a CPU 21, a ROM 22, a RAM 23, a DSP (digital signal processor) 24, a panel 25, an A/D converter (hereinafter "A/D") 26, and a D/A converter (hereinafter "D/A") 27.

The CPU 21 is a central control unit that controls each part of the synthesizer 11 in accordance with fixed values or programs stored in the ROM 22, data stored in the RAM 23 and so on. The CPU 21 controls the DSP 24 by processing data read out from the DSP 24 through the RAM 23 and then supplying the processed data to the DSP 24 through the RAM 23. In addition, the CPU 21 detects a state of a switch or a knob provided on the panel 25 and controls the DSP 24 corresponding to the detected state.

The ROM 22 is a read-only memory that stores a control program executed by the CPU 21, or various tables to which reference is made in executing the control program, and so on. The RAM 23 is a random-access memory utilized for a working area of the CPU 21 or the like. In addition, the RAM 23 can be read and written by the CPU 21, and can also be read and written by the DSP 24. In other words, the RAM 23 also functions as an interface for transferring data between the CPU 21 and the DSP 24.

The DSP 24 carries out a signal process on a digital audio signal supplied from the A/D 26. The A/D 26 converts an analog audio signal inputted from the INPUT terminal of the synthesizer 11 into a digital audio signal and supplies it to the DSP 24. The D/A 27 converts a digital audio signal outputted from the DSP 24 into an analog audio signal and supplies it to the OUTPUT terminal of the synthesizer 11.

[Panel Operating Elements]

Figure 3:
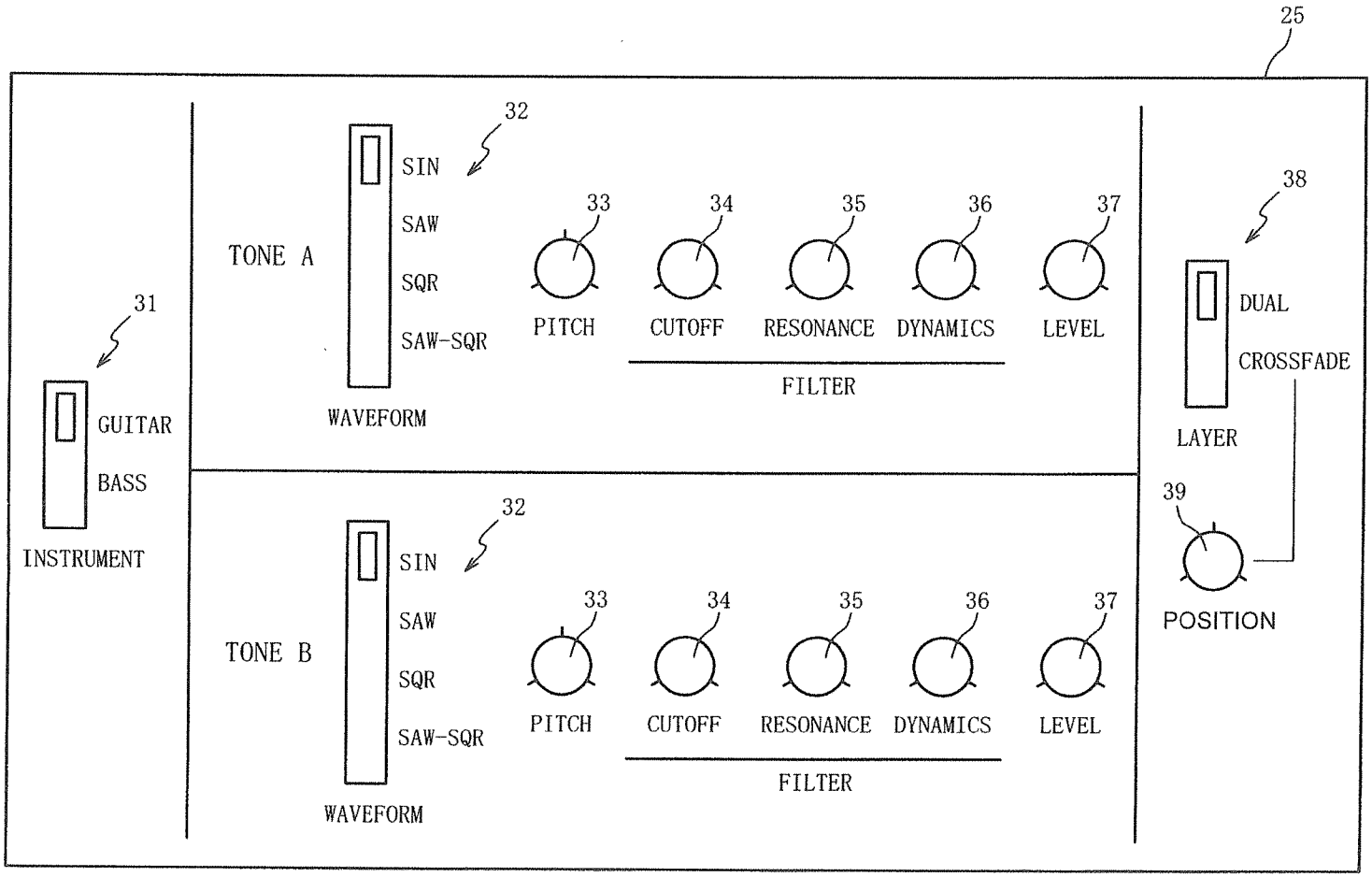
FIG. 3 is a schematic diagram showing a configuration of a panel.

FIG. 3 is a schematic diagram showing a configuration of the panel 25 provided in the synthesizer 11. Various panel operating elements are provided on the panel 25. Specifically, INSTRUMENT (instrument switch) 31, WAVEFORM (waveform selector) 32, PITCH (pitch knob) 33, CUTOFF (cutoff knob) 34, RESONANCE (resonance knob) 35, DYNAMICS (dynamics knob) 36, LEVEL (level knob) 37, LAYER (layer mode switch) 38 and POSITION (position knob) 39 are provided on the panel 25.

The INSTRUMENT 31 is a switch for specifying an instrument that supplies the input sound to the synthesizer 11, i.e., the instrument connected to the INPUT terminal. In this embodiment, the INSTRUMENT 31 is configured as a switch specifying either a guitar or a bass. The synthesizer 11 sets a sound range that can be processed by the device itself in accordance with a sound range of the instrument specified by the INSTRUMENT 31. The details thereof are described later. The INSTRUMENT 31 is equivalent to a band division information specifying means of the invention.

The WAVEFORM 32 is an operating element for setting an output waveform of the synthesizer 11. More specifically, the WAVEFORM 32 is an operating element for setting any one of SIN (sine wave), SAW (sawtooth wave), SQR (square wave) and SAW-SQR (a mixed wave of SAW and SQR) as the output waveform. The WAVEFORM 32 is equivalent to a waveform shape setting means of the invention.

The PITCH 33 is a knob for setting a shift amount (hereinafter "pitch shift amount") for a pitch (frequency) of the input sound. In this embodiment, the PITCH 33 is capable of setting the pitch shift amount in the range from −1 octave to +1 octave. The PITCH 33 is equivalent to a pitch shift amount setting means of the invention.

The CUTOFF 34, the RESONANCE 35 and the DYNAMICS 36 are all knobs for setting actions of a filter 48 (see FIG. 4) provided in the synthesizer 11.

Specifically, the CUTOFF 34 is the knob for setting a cutoff frequency of the filter 48. The RESONANCE 35 is the knob for setting Q (quality) of the filter 48. The DYNAMICS 36 is the knob for setting a degree (depth of effect) of shifting the cutoff frequency of the filter 48 according to level information of the input sound.

The LEVEL 37 is a knob for setting an output level of the synthesizer sound. Each setting value set by each of the operating elements including the WAVEFORM 32, the PITCH 33, the CUTOFF 34, the RESONANCE 35, the DYNAMICS 36 and the LEVEL 37 is information that defines timbre of the synthesizer sound generated by the synthesizer 11. The timbre defined by these setting values are referred to as "tone."

The synthesizer 11 of this embodiment is capable of separately generating synthesizer sounds that have tones of two systems (TONE_A and TONE_B) and that are independent of each other. Each of the operating elements including the WAVEFORM 32, the PITCH 33, the CUTOFF 34, the RESONANCE 35, the DYNAMICS 36 and the LEVEL 37 is prepared respectively for TONE_A and for TONE_B. Accordingly, the tones (timbres) of TONE_A and TONE_B are determined according to a state (condition of operation) of each operating element for setting each tone.

In addition, the synthesizer 11 is capable of overlapping and outputting the synthesizer sounds having the tones defined as TONE_A or TONE_B. The LAYER 38 is a switch for setting a mode of overlapping the synthesizer sound having TONE_A and the synthesizer sound having TONE_B.

In this embodiment, two types of modes, DUAL and CROSSFADE, are prepared as the mode of the overlap. The DUAL mode is a mode in which the sound having TONE_A and the sound having TONE_B are simply added together and outputted.

The CROSSFADE mode is a mode in which a certain pitch is set as a start point, and the sound having TONE_A and the sound having TONE_B are added together with a mixing ratio between the sound having TONE_A and the sound having TONE_B being gradually changed (crossfaded) as a pitch higher than the start point is reached from the start point, and then outputted.

The POSITION 39 is a knob for setting the pitch as the start point of crossfading in the CROSSFADE mode.

[Process Executed by DSP 24]

Figure 4:
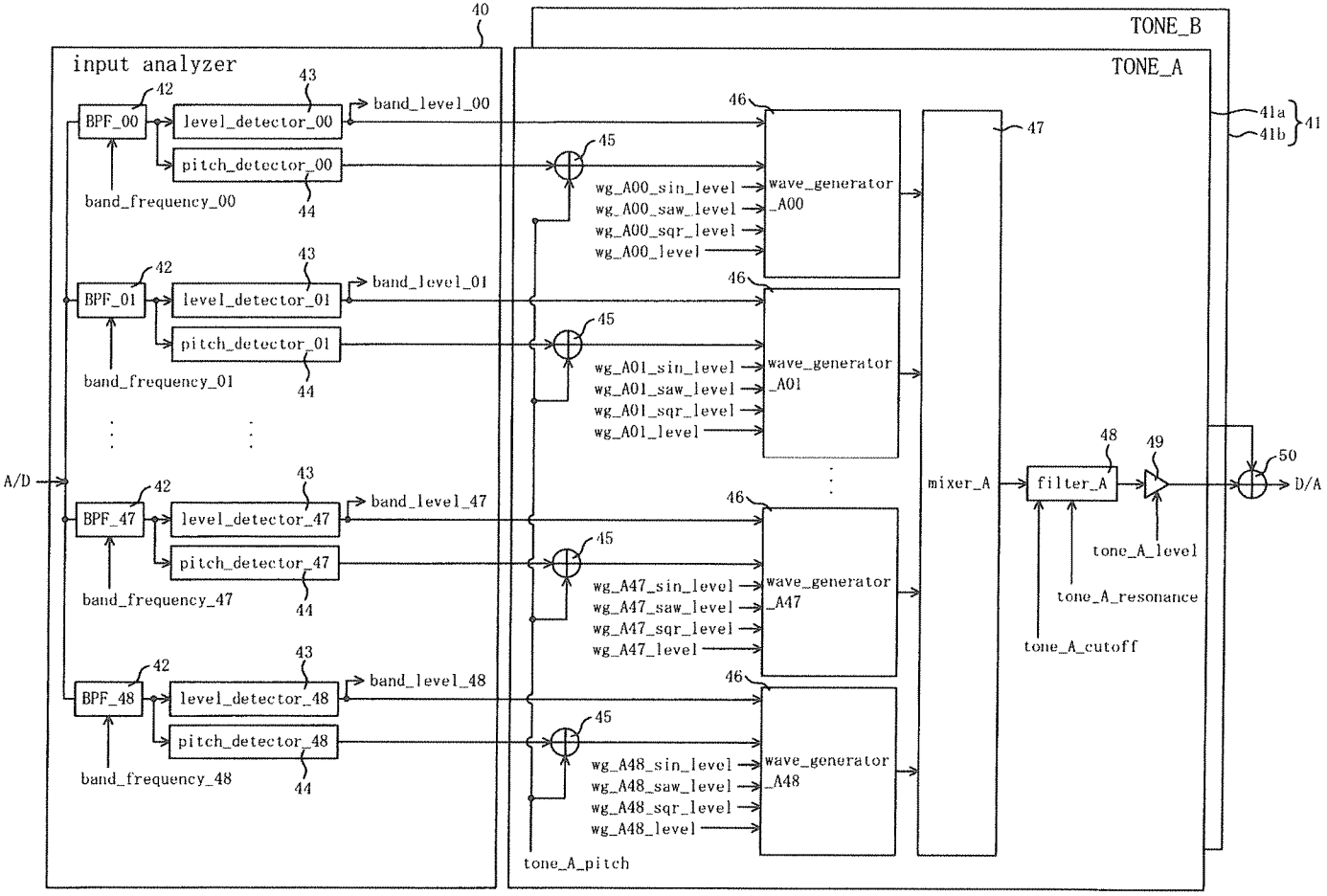
FIG. 4 is a block diagram functionally showing a process executed by a DSP.

FIG. 4 is a block diagram functionally showing a process executed by the DSP 24. The DSP 24 has a function of executing, roughly, (1) an input analysis process 40 and (2) a synthesizer process 41.

The input analysis process 40 is a process of dividing the input sound into a plurality of bands, and detecting the pitch and the level for each band. The synthesizer process 41 is a process of generating, for each band of the divided input sound, a waveform corresponding to the state of each operating element provided on the panel 25, and adding up the waveforms of each band so as to generate the synthesizer sound corresponding to the input sound.

The synthesizer process 41 is executed separately for each available tone. In other words, the synthesizer 11 of this embodiment is capable of utilizing the tones of two systems (TONE_A and TONE_B). Therefore, in this embodiment, the DSP 24 executes, as the synthesizer process 41, a synthesizer process 41*a* for TONE_A and a synthesizer process 41*b* for TONE_B.

(1) Input Analysis Process 40

A band-pass filter (hereinafter "BPF") 42 receives a digital audio signal (i.e., a digital audio signal of the input sound) from the A/D 26, extracts and outputs only a signal component in proximity to a specified center frequency. Forty-nine BPFs 42 are equivalent to a band dividing means of the invention. For the forty-nine BPFs 42, the synthesizer 11 of this embodiment divides the input sound into forty-nine bands by specifying center frequencies that are different from one another.

The forty-nine BPFs 42, i.e., BPF_00 to BPF_48, act in accordance with center frequency information (band_frequency_00 to band_frequency_48) corresponding to each BPF 42 and stored in the RAM 23.

In this embodiment, the center frequencies set respectively for the forty-nine BPFs 42 are determined as follows. Values corresponding to the instrument that can be specified by the INSTRUMENT 31 are set by the CPU 21 and written to the RAM 23. The details thereof are described later. For example, when the instrument specified by the INSTRUMENT 31 is a guitar, the CPU 21 sets the center frequency for each of the forty-nine BPFs 42 in semitones for a sound range of four octaves from E2 (82.4 Hz) to E6 (1318.5 Hz).

That is, the CPU 21 sets the center frequencies respectively for the forty-nine BPFs 42 as follows:

Center frequency of the BPF_00=E2 (82.4 Hz);
Center frequency of the BPF_01=F2 (87.3 Hz);
Center frequency of the BPF_02=F#2 (92.5 Hz);
. . . ;
Center frequency of the BPF_46=D6 (1174.7 Hz);
Center frequency of the BPF_47=D#6 (1244.5 Hz); and
Center frequency of the BPF_48=E6 (1318.5 Hz).

One BPF 42 is connected to a level detector 43 and a pitch detector 44. Therefore, the synthesizer 11 including forty-nine BPFs 42 are provided with forty-nine level detectors 43 and forty-nine pitch detectors 44.

The forty-nine level detectors 43, i.e., level_detector_00 to level_detector_48, detect levels of audio signals outputted from the corresponding BPFs 42 (BPF_00 to BPF_48). Each level detector 43 outputs the detected level as level information of 0.0 to 1.0. The level detector 43 is equivalent to a level detecting means of the invention.

The DSP 24 writes to the RAM 23 the level information outputted from each level detector 43. More specifically, the DSP 24 writes to the RAM 23 the level information outputted from the level_detector_00 to level_detector_48 respectively as band_level_00 to band_level_48 of the RAM 23.

The forty-nine pitch detectors 44, i.e., pitch_detector_00 to pitch_detector_48, detect pitches (frequencies) of the audio signals outputted from the corresponding BPFs 42 (BPF_00 to BPF_48). The pitch detector 44 detects a waveform pitch using a well-known method, e.g., by measuring an interval between zero crossings of the waveform. The pitch detector 44 is equivalent to a pitch detecting means of the invention.

Each pitch detector 44 converts the detected pitch into pitch information and outputs the same. Moreover, the pitch information being 100 times a MIDI (musical instrument digital interface) note number (0 to 127) is treated as a numerical value capable of expressing a cent value. For example, the pitch of the note number A4 is represented by a numerical value 69×100=6900.

The pitch detector 44 of this embodiment is capable of detecting a pitch at a resolution finer than a chromatic pitch. Accordingly, when the pitch detector 44 detects a pitch three cents higher than the pitch of A4, the pitch detector 44 outputs a value 6900+3=6903 as the pitch information. Here, the reason for specifying the resolution of the pitch detector 44 to be finer than that of a chromatic scale is to reflect tiny pitch variations that occur in a guitar performance in the synthesizer sound and to reflect, in the synthesizer sound, smooth pitch variations caused by bending as a common guitar playing method.

Moreover, because the pitch detector 44 of this embodiment performs pitch detection for the audio signal having a frequency range limited by the BPF 42 of the preceding stage, there is no need to detect a pitch in a wide range such as over several octaves, as with a conventional pitch detector. Therefore, it is satisfactory to detect a pitch in a range of, e.g., plus and minus several hundred cents.

Hence, in pitch detection in the conventional synthesizer, when erroneous detection occurs, the erroneous detection will consequently be markedly reflected in an output sound, such as the synthesizer sound may be produced at a pitch one octave different from the correct pitch. However, the pitch detector 44 of this embodiment, even when performing erroneous detection, is capable of considerably reducing the bad influence of the erroneous detection on the output sound due to a relatively narrow range of the erroneous detection.

Furthermore, conventionally, various smoothing (stabilizing) processes are provided as countermeasures against erroneous detection, by which responsiveness of the synthesizer sound to performance is sacrificed. However, in the synthesizer 11 of the invention, since a practically usable detection result can be obtained by a simple smoothing process, the responsiveness of the synthesizer sound can be prevented from being sacrificed.

(2) Synthesizer Process 41

As described above, in this embodiment, the DSP 24 executes, as the synthesizer process 41, the synthesizer process 41*a* for TONE_A and the synthesizer process 41*b* for TONE_B. Since the synthesizer processes 41*a* and 41*b* are the same process, the following description mainly describes the synthesizer process 41*a* for TONE_A.

An adder 45 outputs a value obtained by adding a pitch shift amount (tone_*_pitch) to the pitch information from the pitch detector 44. Moreover, the symbol "*" in this specification indicates either TONE_A or TONE_B. For example, when indicating TONE_A, *=A.

Therefore, the adder 45 for TONE_A outputs a value obtained by adding tone_A_pitch to the pitch information from the corresponding pitch detector 44. On the other hand, the adder 45 for TONE_B outputs a value obtained by adding tone_B_pitch to the pitch information from the corresponding pitch detector 44.

A waveform generator 46 generates a waveform corresponding to the state of each operating element provided on the panel 25. For example, the waveform generator 46 for TONE_A generates a waveform of TONE_A corresponding to the state of each operating element provided on the panel 25.

The waveform generator 46 is provided corresponding to each BPF 42 according to the number of the BPF 42. Therefore, the synthesizer 11 including forty-nine BPFs 42 is provided with forty-nine waveform generators 46 for TONE_A, i.e., wave_generator_A00 to wave_generator_A48. Similarly, forty-nine waveform generators 46 for TONE_B, i.e., wave_generator_B00 to wave_generator_B48, are provided for TONE_B.

To each waveform generator 46, the level information from the corresponding level detector 43, the output from the adder 45 and various parameter information (specifically, wg_*_sin_level, wg_*_saw_level, wg_*_sqr_level and wg_*_level) stored in the RAM 23 are inputted. Each waveform generator 46 acts according to the inputted information.

Moreover, the symbol "*" in this specification indicates either TONE_A or TONE_B and indicates to which one of the BPF_00 to BPF_48 the element corresponds. For example, when indicating TONE_A and corresponding to the BPF_00, *=A00.

Accordingly, a synthesizer sound corresponding to the level information and pitch information of a band outputted from the corresponding BPF 42, specifically, a synthesizer sound that has a period corresponding to the pitch information and a level corresponding to the level information and that corresponds to the state of each operating element provided on the panel 25, is generated.

The waveform generator 46 is equivalent to a waveform generating means, a waveform period control means and a waveform level control means of the invention. In addition, the waveform generator 46 for TONE_A is equivalent to a first waveform generating means of the invention, and the waveform generator 46 for TONE_B is equivalent to a second waveform generating means of the invention.

The wg_*_sin_level, wg_*_saw_level and wg_*_sqr_level are parameter information for setting the waveform of the synthesizer sound. The wg_*_level is parameter information for setting the output level of the synthesizer sound.

Therefore, for example, the wave_generator_A00 corresponding to the BPF_00 acts according to the level information from the level_detector_00, the output (a value obtained by adding tone_A_pitch to the pitch information from the pitch_detector_00) from the adder 45 and the various parameter information (wg_A00_sin_level, wg_A00_saw_level, wg_A00_sqr_level and wg_A00_level) stored in the RAM 23.

The same also applies to the wave_generator_A01 to wave_generator_A48 and the wave_generator_B00 to wave_generator_B48.

A mixer 47 adds up all the synthesizer sounds outputted from each waveform generator 46 corresponding to each BPF 42 and outputs a result thereof. Therefore, the mixer 47 for TONE_A, i.e., the mixer_A, adds up all the synthesizer sounds outputted from the wave_generator_A00 to wave_generator_A48 and outputs a result thereof. On the other hand, the mixer 47 for TONE_B, i.e., the mixer_B, adds up all the synthesizer sounds outputted from the wave_generator_B00 to wave_generator_B48 and outputs a result thereof.

The mixer 47 is equivalent to an adding means of the invention. In addition, the mixer 47 for TONE_A is equivalent to a first adding means of the invention, and the mixer 47 for TONE_B is equivalent to a second adding means of the invention.

A filter 48 is a filter for processing the synthesizer sound (i.e., that obtained by adding up the synthesizer sounds of each frequency band) outputted from the mixer 47. Therefore, the filter 48 for TONE_A, i.e., the filter_A, processes the synthesizer sound outputted from the mixer_A. On the other hand, the filter 48 for TONE_B, i.e., the filter_B, processes the synthesizer sound outputted from the mixer_B. The filter 48 is equivalent to a filter means of the invention.

The filter 48 acts as a low pass filter (hereinafter "LPF") that removes components having a higher frequency than a cutoff frequency (tone_A_cutoff, tone_B_cutoff) specified for TONE_A or for TONE_B.

In addition, for a resonance (tone_A_resonance, tone_B_resonance) specified for TONE_A or for TONE_B, the filter 48 changes filter characteristics (frequency characteristics) in the vicinity of the cutoff frequency by changing the Q of the applicable filter 48 (filter_A, filter_B), and consequently outputs an interesting sound as the synthesizer sound.

The filter 48 is connected to a multiplier 49. The multiplier 49 increases or decreases a volume by multiplying the output level of the synthesizer sound set by the LEVEL 37. The multiplier 49 for TONE_A multiplies the output level (tone_A_level) set by the LEVEL 37 for TONE_A. On the other hand, the multiplier 49 for TONE_B multiplies the output level (tone_B_level) set by the LEVEL 37 for TONE_B.

The synthesizer sound having TONE_A outputted from the multiplier 49 for TONE_A and the synthesizer sound having TONE_B outputted from the multiplier 49 for TONE_B are added up by an adder 50. The synthesizer sound obtained through the addition is supplied to the D/A 27.

Figure 5:
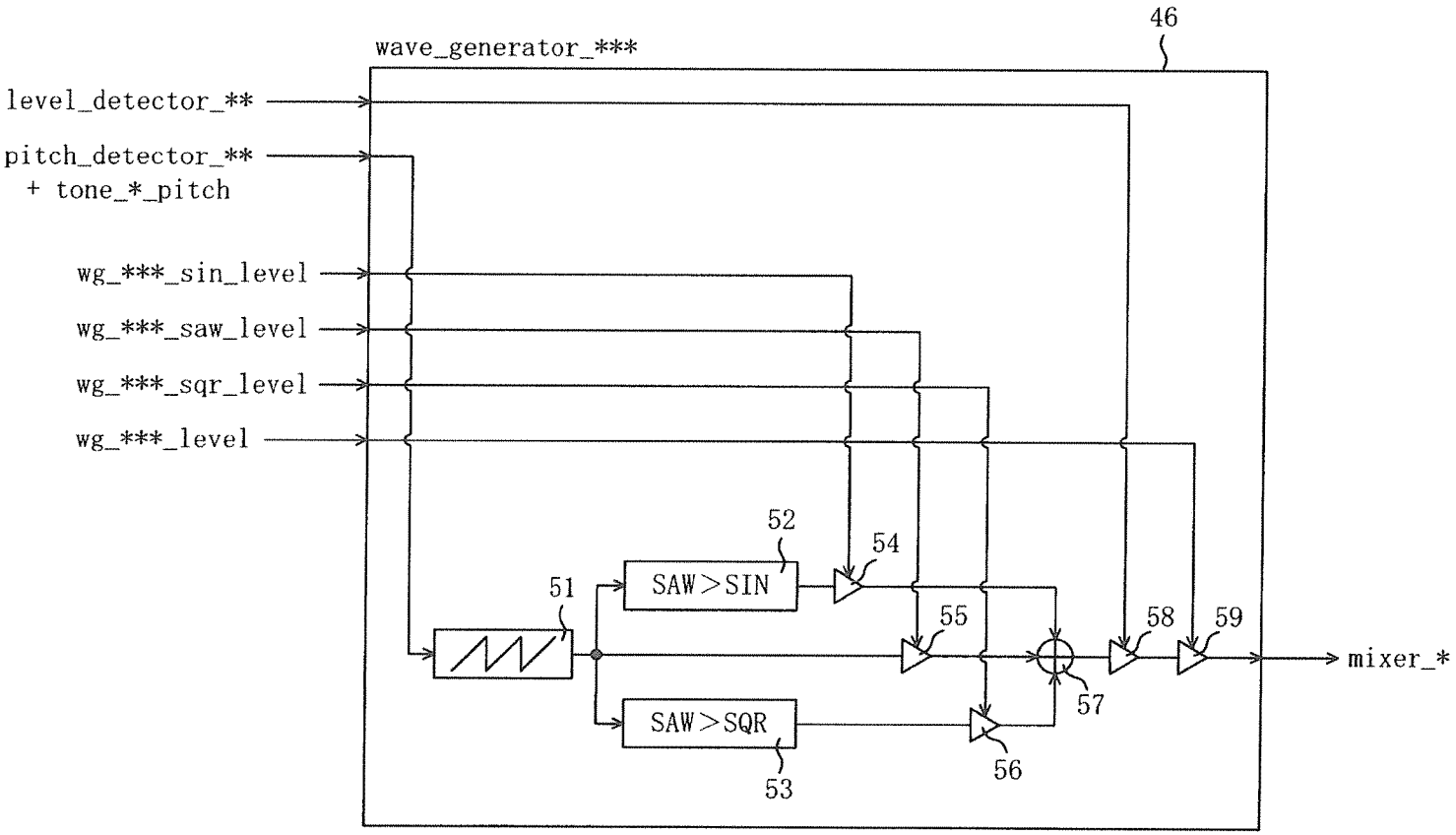
FIG. 5 is a block diagram for illustrating a waveform generator.

FIG. 5 is a block diagram for illustrating the aforementioned waveform generator 46. The waveform generators 46 of this embodiment, i.e., the wave_generator_A00 to wave_generator_A48 and the wave_generator_B00 to wave_generator_B48, all have the same configuration.

A sawtooth wave generator 51 generates a sawtooth wave having a frequency corresponding to a value obtained by adding up the pitch information supplied from the corresponding pitch detector 44 (pitch_detector_**) and the corresponding pitch shift amount (tone_*_pitch). The pitch shift amount is stored in the RAM 23. Moreover, the symbol "" in this specification indicates to which one of the BPF_00 to BPF_48 the element corresponds. For example, when corresponding to the BPF_00, =00.

The sawtooth wave generator 51 generates a sawtooth wave having an amplitude of −1.0 to 1.0. More specifically, the sawtooth wave generator 51 obtains an incremental value for a frequency specified according to the pitch information, and integrates the incremental value at a frequency being a sampling rate at which the DSP 24 acts. When the incremental value reaches 1.0 or greater, the sawtooth wave generator 51 decreases 2.0 from the incremental value. The sawtooth wave generator 51 repeats this operation so as to generate a sawtooth wave having the frequency corresponding to the pitch information and the amplitude of −1.0 to 1.0.

A sine wave converter 52 converts the sawtooth wave having the amplitude of −1.0 to 1.0 that was outputted from the sawtooth wave generator 51 into a sine wave having the amplitude of −1.0 to 1.0 and outputs the same. The frequency of the sine wave outputted from the sine wave converter 52 is the same as the frequency of the sawtooth wave (i.e., the sawtooth wave outputted from the sawtooth wave generator 51) inputted to the sine wave converter 52. Moreover, the conversion performed by the sine wave converter 52 can be realized by using a function that converts the values −1.0 to 1.0 of the sawtooth wave into $\sin(-\pi)$ to $\sin(+\pi)$ or by using a table for conversion.

A square wave converter 53 converts the sawtooth wave having the amplitude of −1.0 to 1.0 that was outputted from the sawtooth wave generator 51 into a square wave having the amplitude of −1.0 to 1.0 and outputs the same. The frequency of the square wave outputted from the square wave converter 53 is the same as the frequency of the sawtooth wave (i.e., the sawtooth wave outputted from the sawtooth wave generator 51) inputted to the square wave converter 53.

Moreover, the conversion performed by the square wave converter 53 can be realized by a conversion that matches the values −1.0 to 1.0 of the sawtooth wave to 1.0 if the values are 0 or greater and to −1.0 if the values are negative.

A multiplier 54 is for changing the output level of the sine wave converter 52. The multiplier 54 multiplies the output from the sine wave converter 52 by a value of the parameter information (wg_*_sin_level) that is stored in the RAM 23 and is for setting the sine wave. The wg_*_sin_level may be a value from 0.0 to 1.0.

A multiplier 55 is for changing the output level of the sawtooth wave generator 51. The multiplier 55 multiplies the output from the sawtooth wave generator 51 by a value of the parameter information (wg_*_saw_level) that is stored in the RAM 23 and is for setting the sawtooth wave. The wg_*_saw_level may be a value from 0.0 to 1.0.

A multiplier 56 is for changing the output level of the square wave converter 53. The multiplier 56 multiplies the output from the square wave converter 53 by a value of the parameter information (wg_*_sqr_level) that is stored in the RAM 23 and is for setting the square wave. The wg_*_sqr_level may be a value from 0.0 to 1.0.

An adder 57 is for adding up the sine wave outputted from the multiplier 54, the sawtooth wave outputted from the multiplier 55 and the square wave outputted from the multiplier 56.

A multiplier 58 is for controlling and outputting the level of an output signal from the adder 57 according to the level information supplied from the corresponding level detector 43 (level_detector_**).

A multiplier 59 is for changing the level of the output signal from the multiplier 58. The multiplier 59 multiplies the output signal from the multiplier 58 by the parameter information (wg_*_level) that is stored in the RAM 23 and is for setting the output level of the synthesizer sound. The wg_*_level may be a value from 0.0 to 1.0.

In this way, the waveform generator 46 (wave_generator_*) outputs the synthesizer sound corresponding to the level detected by the level detector 43 and the pitch detected by the pitch detector 44. The synthesizer sound outputted from the multiplier 59 is supplied to the corresponding mixer 47** (mixer_*).

[Information Stored in RAM 23]

The information stored in the RAM 23 is described with reference to FIGS. 6A, 6B and 7. FIG. 6A shows the information written to the RAM 23 by the DSP 24 and read out from the RAM 23 by the CPU 21. Information 61 is the level information outputted by each level detector 43.

Specifically, the DSP 24 writes to the RAM 23 the level information (band_level_00 to band_level_48) respectively outputted by the forty-nine level detectors 43 (i.e., level_detector_00 to level_detector_48). The CPU 21 reads out the level information stored in the RAM 23 in the later-described periodic process (see FIG. 15) in order to control the filters 48 for TONE_A and for TONE_B.

FIG. 6B shows the information written to the RAM 23 by the CPU 21 and read out from the RAM 23 by the CPU 21. Information 62 corresponds to positions of the knobs of the CUTOFF 34 and the DYNAMICS 36. Specifically, the information 62 includes parameter_A_cutoff, parameter_A_dynamics, parameter_B_cutoff, and parameter_B_dynamics. The aforementioned information is written to the RAM 23 by the CPU 21 in the later-described panel process (see FIG. 8) and read out by the periodic process.

FIG. 7 shows the information written to the RAM 23 by the CPU 21 and read out from the RAM 23 by the DSP 24. Moreover, this information is particularly referred to as "parameter information," and is used as information for transmitting a setting value corresponding to an operation on the panel 25 to the DSP 24.

The parameter information 71 is a center frequency set for each BPF 42. Specifically, the CPU 21 writes to the RAM 23 each value corresponding to a switch position of the INSTRUMENT 31 as the center frequency (band_frequency_00 to band_frequency_48) for each of the forty-nine BPFs 42 (i.e., BPF_00 to BPF_48).

Moreover, the center frequency of each BPF 42 corresponding to the switch position of the INSTRUMENT 31 is prepared in the ROM 22 for the instrument (a guitar or a bass in this embodiment) that can be specified by the INSTRUMENT 31.

Parameter information 72 is parameter information set according to the various operating elements provided for TONE_A. In other words, the parameter information 72 defines TONE_A. The parameter information 72 includes wg_A_sin_level, wg_A_saw_level, wg_A_sqr_level, wg_A_level, tone_A_pitch, tone_A_cutoff, tone_A_resonance and tone_A_level.

The wg_A_sin_level, wg_A_saw_level and wg_A_sqr_level are parameter information for setting the waveform of the synthesizer sound outputted from each waveform generator 46 (wave_generator_A) for TONE_A.

The CPU 21 writes each of values of the wg_A_sin_level (wg_A00_sin_level to wg_A48_sin_level), wg_A_saw_level (wg_A00_saw_level to wg_A48_saw_level) and wg_A_sqr_level (wg_A00_sqr_level to wg_A48_sqr_level) according to a selector position of the WAVEFORM 32** for TONE_A.

Moreover, the values of the wg_A_sin_level, wg_A_saw_level and wg_A_sqr_level corresponding to the selector position of the WAVEFORM 32 are respectively prepared in the ROM 22 for the waveform (SIN, SAW, SQR and SAW-SQR in this embodiment) that can be set by the WAVEFORM 32**.

The wg_A_level is parameter information for setting the level of the synthesizer sound outputted from each waveform generator 46 (wave_generator_A) for TONE_A. The CPU 21 writes each of values of the wg_A_level (wg_A00_level to wg_A48_level) according to positions of the LAYER 38 and the POSITION 39**.

The tone_A_pitch is parameter information for setting the pitch (frequency) of the synthesizer sound outputted from each waveform generator 46 (wave_generator_A) for TONE_A. The CPU 21 writes the value of the tone_A_pitch according to the knob position of the PITCH 33** for TONE_A.

The tone_A_cutoff is parameter information for setting the cutoff frequency of the filter 48 for TONE_A (filter_A). The CPU 21 writes the value of the tone_A_cutoff according to the later-described periodic process (see FIG. 15).

The tone_A_resonance is parameter information for setting the Q of the filter 48 for TONE_A (filter_A). The CPU 21 writes the value of the tone_A_resonance according to the knob position of the RESONANCE 35 for TONE_A.

The tone_A_level is parameter information for setting the level of the synthesizer sound having TONE_A. The CPU 21 writes the value of the tone_A_level according to the knob position of the LEVEL 37 for TONE_A.

Parameter information 73 is parameter information set according to the various operating elements provided for TONE_B. In other words, the parameter information 73 defines TONE_B. The parameter information 73 is similar to the parameter information 72, and the above description may apply if "A" is replaced with "B."

[Process Executed by CPU 21]

The CPU 21 executes (1) panel process and (2) periodic process. The CPU 21 includes a timer (not illustrated), and is capable of calling a process at time intervals corresponding to the type of the process, and then executing the process.

The CPU 21 executes the panel process per 20 msec. On the other hand, the CPU 21 executes the periodic process per 2 msec. This is because the periodic process concerns the control of timbre variation of the synthesizer, and when an interval between executions of the processes is too long, the timbre variation becomes stepwise and loses smoothness.

(1) Panel Process

Figure 8:
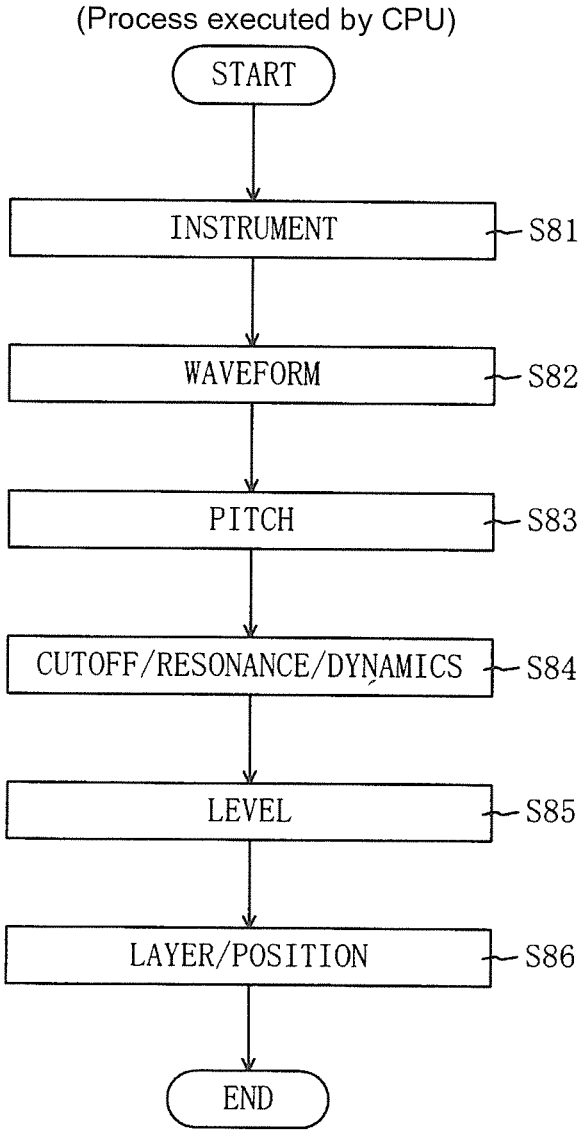
FIG. 8 is a flowchart showing a panel process executed by a CPU.

FIG. 8 is a flowchart showing the panel process executed by the CPU 21. The panel process is a process of detecting the state (condition of operation) of each operating element provided on the panel 25 and writing information (parameter information) corresponding to the detected state to the RAM 23, thereby controlling the DSP 24.

As shown in FIG. 8, after the panel process starts, the CPU 21 writes to the RAM 23 the parameter information corresponding to the positions of the INSTRUMENT 31, the WAVEFORM 32 and the PITCH 33 (S81, S82 and S83). Next, the CPU 21 writes to the RAM 23 the parameter information corresponding to the positions of the CUTOFF 34, the RESONANCE 35 and the DYNAMICS 36 as the parameter information to control the filter 48 (S84).

Next, the CPU 21 writes to the RAM 23 the parameter information corresponding to the position of the LEVEL 37 (S85). Next, the CPU 21 writes to the RAM 23 the parameter information corresponding to the positions of the LAYER 38 and the POSITION 39 (S86), and ends this process. Moreover, among the aforementioned processes, with respect to steps S82 to S85, the CPU 21 writes the parameter information corresponding to the positions of the operating elements respectively for TONE_A and TONE_B.

The aforementioned processes are described in detail. Hereinafter, TONE_A is described as a representative example, but for TONE_B, the situation is the same. The following description may apply to TONE_B if "A" is replaced with "B."

<S81: INSTRUMENT>

In step S81, the CPU 21 writes to the RAM 23 the parameter information corresponding to the switch position of the INSTRUMENT 31, more specifically, the center frequency of each BPF 42 (band_frequency_00 to band_frequency_48). Accordingly, the center frequencies of the BPF_00 to BPF_48 are set respectively as values of the band_frequency_00 to band_frequency_48.

Figure 9:
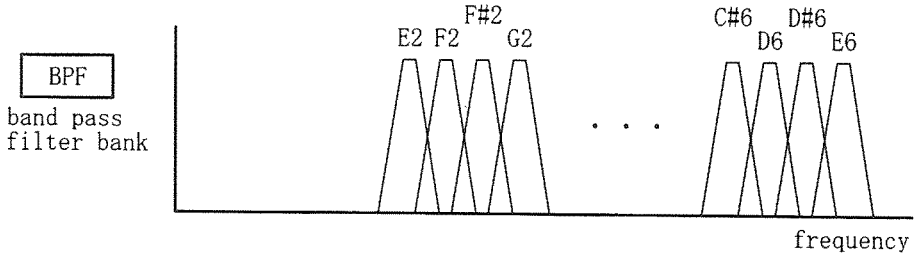
FIG. 9 shows a list of center frequencies to be written when an input sound is a guitar sound.

FIG. 9 shows a list of center frequencies to be written when an input sound is a guitar sound. Specifically, the frequencies of semitones in the range of E2 (82.4 Hz) to E6 (1318.5 Hz) are assigned as the band_frequency_00 to band_frequency_48. The list is prepared in the ROM 22.

When the instrument specified by the INSTRUMENT 31 is a guitar, in step S81, the CPU 21 writes to the RAM 23 each of the values of the band_frequency_00 to band_frequency_48 shown in FIG. 9. As a result, a sound (input sound) inputted from the INPUT terminal passes through each BPF 42, and is thereby divided into semitone bands in the frequency range of E2 (82.4 Hz) to E6 (1318.5 Hz), and the waveform generator 46 acts according to the level information and the pitch information of each frequency band.

Figure 10:
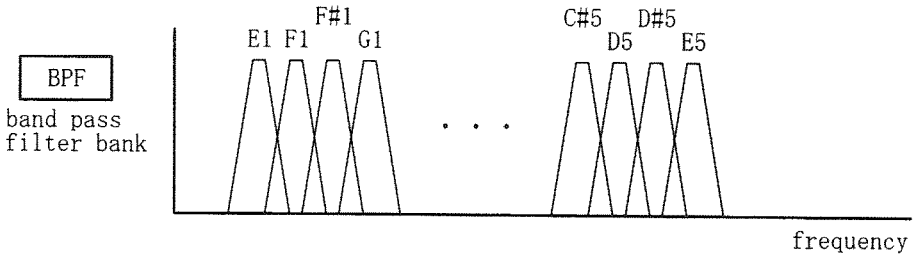
FIG. 10 shows a list of center frequencies to be written when the input sound is a bass sound.

FIG. 10 shows a list of center frequencies to be written when the input sound is a bass sound. Specifically, the frequencies in units of semitones in the range of E1 (41.2 Hz) to E5 (659.3 Hz) are assigned as the band_frequency_00 to band_frequency_48. In other words, when the input sound is a bass sound, the center frequency is half (i.e., one octave lower than) the center frequency in the case where the input sound is a guitar sound. Moreover, the list is prepared in the ROM 22.

When the instrument specified by the INSTRUMENT 31 is a bass, in step S81, the CPU 21 writes to the RAM 23 each of the values of the band_frequency_00 to band_frequency_48 shown in FIG. 10. As a result, a sound (input sound) inputted from the INPUT terminal passes through each BPF 42, and is thereby divided into bands in units of semitones in the frequency range of E1 (41.2 Hz) to E5 (659.3 Hz), and the waveform generator 46 acts according to the level information and the pitch information of each frequency band.

In this way, according to the synthesizer 11 of this embodiment, the parameter information (specifically, center frequency) set for each BPF 42 for each instrument that can be specified by the INSTRUMENT 31 is prepared in advance in the ROM 22. The synthesizer 11 writes to the RAM 23 the parameter information corresponding to the switch position of the INSTRUMENT 31, thereby matching the sound range processed by a plurality of BPFs 42 to the sound range of the instrument specified by the switch, and setting the bands divided by the BPFs according to the instrument. Accordingly, for various instruments, there is no need to provide a large number of BPFs for covering a wide frequency range in order to comprehensively cope with all the instruments, but a plurality of types of instruments can be properly coped with by a limited number of BPFs. Therefore, manufacturing cost of the synthesizer 11 can be reduced.

Moreover, the ROM 22 that stores the parameter information corresponding to the switch position of the INSTRUMENT 31 (e.g., the parameter information shown in FIG. 9 or FIG. 10) is equivalent to a memory means of the invention.

<S82: WAVEFORM>

In step S82, the CPU 21 writes to the RAM 23 the parameter information corresponding to the selector position of the WAVEFORM 32, more specifically, values of the wg_*_sin_level, wg_*_saw_level and wg_***_sqr_level.

In other words, the CPU 21 writes to the RAM 23 the values of the wg_A00_sin_level to wg_A48_sin_level, the wg_A00_saw_level to wg_A48_saw_level and the wg_A00_sqr_level to wg_A48_sqr_level corresponding to the selector position of the WAVEFORM 32 for TONE_A. For TONE_B, the CPU 21 writes to the RAM 23 the parameter information corresponding to the selector position of the WAVEFORM 32 for TONE_B.

FIG. 11A shows a list of parameter information to be written when the WAVEFORM 32 for TONE_A is set to SIN. Specifically, all the wg_A00_sin_level to wg_A48_sin_level are assigned 1.0, all the wg_A00_saw_level to wg_A48_saw_level are assigned 0.0, and all the wg_A00_sqr_level to wg_A48_sqr_level are assigned 0.0. The list is prepared in the ROM 22.

When the WAVEFORM 32 for TONE_A is set to SIN, in step S82, the CPU 21 writes to the RAM 23 the values of the wg_A_sin_level, wg_A_saw_level and wg_A_sqr_level shown in FIG. 11A. As a result, the waveform generators 46** for TONE_A (i.e., wave_generator_A00 to wave_generator_A48) all generate a sine wave.

FIG. 11B shows a list of parameter information to be written when the WAVEFORM 32 for TONE_A is set to SAW. Specifically, all the wg_A00_sin_level to wg_A48_sin_level are assigned 0.0, all the wg_A00_saw_level to wg_A48_saw_level are assigned 1.0, and all the wg_A00_sqr_level to wg_A48_sqr_level are assigned 0.0. The list is prepared in the ROM 22.

When the WAVEFORM 32 for TONE_A is set to SAW, in step S82, the CPU 21 writes to the RAM 23 the values of the wg_A_sin_level, wg_A_saw_level and wg_A_sqr_level shown in FIG. 11B. As a result, the waveform generators 46** for TONE_A (i.e., wave_generator_A00 to wave_generator_A48) all generate a sawtooth wave.

FIG. 11C shows a list of parameter information to be written when the WAVEFORM 32 for TONE_A is set to SQR. Specifically, all the wg_A00_sin_level to wg_A48_sin_level are assigned 0.0, all the wg_A00_saw_level to wg_A48_saw_level are assigned 0.0, and all the wg_A00_sqr_level to wg_A48_sqr_level are assigned 1.0. The list is prepared in the ROM 22.

When the WAVEFORM 32 for TONE_A is set to SQR, in step S82, the CPU 21 writes to the RAM 23 the values of the wg_A_sin_level, wg_A_saw_level and wg_A_sqr_level shown in FIG. 11C. As a result, the waveform generators 46** for TONE_A (i.e., wave_generator_A00 to wave_generator_A48) all generate a square wave.

FIG. 11D shows a list of parameter information to be written when the WAVEFORM 32 for TONE_A is set to SAW-SQR. Specifically, all the wg_A00_sin_level to wg_A48_sin_level are assigned 0.0. On the other hand, the wg_A00_saw_level to wg_A48_saw_level are respectively assigned values that gradually decrease from 1.0 (=48.0/48.0) to reach 0.0 (=0.0/48.0). In addition, the wg_A00_sqr_level to wg_A48_sqr_level are respectively assigned values that gradually increase from 0.0 (=0.0/48.0) to reach 1.0 (=48.0/48.0). The list is prepared in the ROM 22.

When the WAVEFORM 32 for TONE_A is set to SAW-SQR, in step S82, the CPU 21 writes to the RAM 23 the values of the wg_A_sin_level, wg_A_saw_level and wg_A_sqr_level shown in FIG. 11D. As a result, the waveform generators 46** for TONE_A (i.e., wave_generator_A00 to wave_generator_A48) respectively generate different waveforms.

Figure 12:
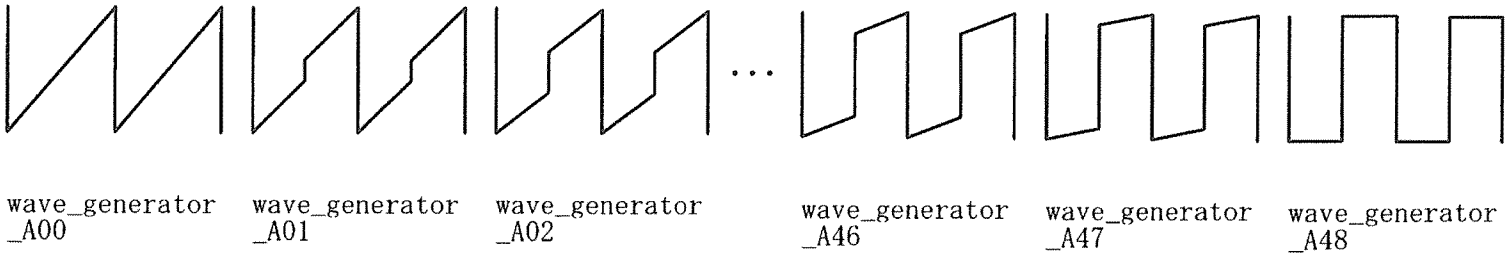
FIG. 12 shows waveforms generated by each waveform generator when the operating element WAVEFORM is set to SAW-SQR.

Specifically, the wave_generator_A00 generates a sawtooth wave while the wave_generator_A48 generates a square wave. The waveform generators 46 between the wave_generator_A00 and the wave_generator_A48, i.e., the wave_generator_A01 to wave_generator_A47, generate a synthetic waveform of sawtooth wave and square wave. More specifically, the wave_generator_A01 to wave_generator_A47 output a synthetic waveform in which the proportion of sawtooth wave gradually decreases and the proportion of square wave gradually increases. FIG. 12 shows waveforms generated by each waveform generator 46 when the WAVEFORM 32 for TONE_A is set to SAW-SQR.

<S83: PITCH>

In step S83, the CPU 21 writes to the RAM 23 the parameter information corresponding to the knob position of the PITCH 33, more specifically, a value of the tone_*_pitch. In other words, the CPU 21 writes to the RAM 23 the value of the tone_A_pitch corresponding to the knob position of the PITCH 33 for TONE_A. For TONE_B, the CPU 21 writes to the RAM 23 the value of the tone_B_pitch corresponding to the knob position of the PITCH 33 for TONE_B.

Specifically, when the knob position of the PITCH 33 for TONE_A is the minimum position, the CPU 21 writes to the RAM 23 a cent value of −1200 that indicates −1 octave as the tone_A_pitch. On the other hand, when the knob position of the PITCH 33 for TONE_A is the maximum position, the CPU 21 writes to the RAM 23 a cent value of +1200 that indicates +1 octave as the tone_A_pitch. In addition, when the knob position of the PITCH 33 for TONE_A is between the minimum position and the maximum position, the CPU 21 sets the middle position to 0, and writes to the RAM 23 a value in which a cent value continuously changes according to the position as the tone_A_pitch.

The tone_*_pitch written to the RAM 23 acts as the pitch shift amount in the synthesizer process 41 of the DSP 24. If the tone_*_pitch=0, a synthesizer sound having the same pitch (frequency) as the detected pitch is outputted from the waveform generator 46 for the corresponding tone.

<S84: CUTOFF/RESONANCE/DYNAMICS>

In step S84, the CPU 21 writes to the RAM 23 the parameter information corresponding to the knob position of the CUTOFF 34, more specifically, a value of parameter_*_cutoff. In other words, the CPU 21 writes to the RAM 23 the value of the parameter_A_cutoff corresponding to the knob position of the CUTOFF 34 for TONE_A. For TONE_B, the CPU 21 writes to the RAM 23 the value of the parameter_B_cutoff corresponding to the knob position of the CUTOFF 34 for TONE_B.

The parameter_*_cutoff is the cutoff frequency of the filter 48 (i.e., filter_A or filter_B) for the corresponding tone. The CPU 21 adds the level information outputted from the level detector 43 to the parameter_*_cutoff (i.e., the cutoff frequency of the filter 48) written into the RAM 23, and writes tone_*_cutoff into the RAM 23 so as to control the filter 48. The details thereof are described later.

In addition, in step S84, the CPU 21 writes to the RAM 23 the parameter information corresponding to the knob position of the RESONANCE 35, more specifically, a value of tone_*_resonance. In other words, the CPU 21 writes to the RAM 23 the value of the tone_A_resonance corresponding to the knob position of the RESONANCE 35 for TONE_A. For TONE_B, the CPU 21 writes to the RAM 23 the value of the tone_B_resonance corresponding to the knob position of the RESONANCE 35 for TONE_B.

Specifically, when the knob position of the RESONANCE 35 for TONE_A is the minimum position, the CPU 21 writes to the RAM 23 1.0 as the tone_A_resonance. On the other hand, when the knob position of the RESONANCE 35 for TONE_A is the maximum position, the CPU 21 writes to the RAM 23 8.0 as the tone_A_resonance. In addition, when the knob position of the RESONANCE 35 for TONE_A is between the minimum position and the maximum position, the CPU 21 writes to the RAM 23 a value that continuously increases according to the position as the tone_A_resonance.

The tone_*_resonance written to the RAM 23 acts as the Q (quality) of the filter 48 in the synthesizer process 41 of the DSP 24.

In addition, in step S84, the CPU 21 writes to the RAM 23 the parameter information corresponding to the knob position of the DYNAMICS 36, more specifically, a value of parameter_*_dynamics. In other words, the CPU 21 writes to the RAM 23 the value of the parameter_A_dynamics corresponding to the knob position of the DYNAMICS 36 for TONE_A. For TONE_B, the CPU 21 writes to the RAM 23 the value of the parameter_B_dynamics corresponding to the knob position of the DYNAMICS 36 for TONE_B.

The parameter_*_dynamics written to the RAM 23 acts as the degree (depth of effect) of changing the cutoff frequency of the filter 48 according to the level information in the synthesizer process 41 of the DSP 24.

<S85: LEVEL>

In step S85, the CPU 21 writes to the RAM 23 the parameter information corresponding to the knob position of the LEVEL 37, more specifically, a value of tone_*_level. In other words, the CPU 21 writes to the RAM 23 the value of the tone_A_level corresponding to the knob position of the LEVEL 37 for TONE_A. For TONE_B, the CPU 21 writes to the RAM 23 the value of the tone_B_level corresponding to the knob position of the LEVEL 37 for TONE_B.

Specifically, when the knob position of the LEVEL 37 for TONE_A is the minimum position, the CPU 21 writes to the RAM 23 0.0 as the tone_A_level. On the other hand, when the knob position of the LEVEL 37 for TONE_A is the maximum position, the CPU 21 writes to the RAM 23 1.0 as the tone_A_level. In addition, when the knob position of the LEVEL 37 for TONE_A is between the minimum position and the maximum position, the CPU 21 writes to the RAM 23 a value that continuously increases according to the position as the tone_A_level.

<S86: LAYER/POSITION>

In step S86, the CPU 21 writes to the RAM 23 the parameter information corresponding to the switch position of the LAYER 38, more specifically, a value of the wg_*_level. In other words, the CPU 21 writes to the RAM 23 the values of the wg_A00_level to wg_A48_level and wg_B00_level to wg_B48_level corresponding to the switch position of the LAYER 38**.

Figure 13:
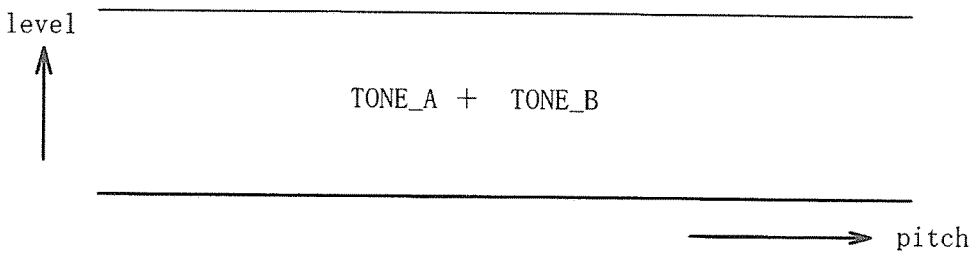
FIG. 13 schematically shows the configuration mode of the parameter information when an operating element LAYER is set to DUAL.

FIG. 13 schematically shows the configuration mode of the parameter information when the LAYER 38 is set to DUAL. When the LAYER 38 is set to DUAL, the sound having TONE_A and the sound having TONE_B are simply added together. Therefore, in such case, the CPU 21 writes to the RAM 23 1.0 as all the wg_A00_level to wg_A48_level and the wg_B00_level to wg_B48_level.

Figure 14:
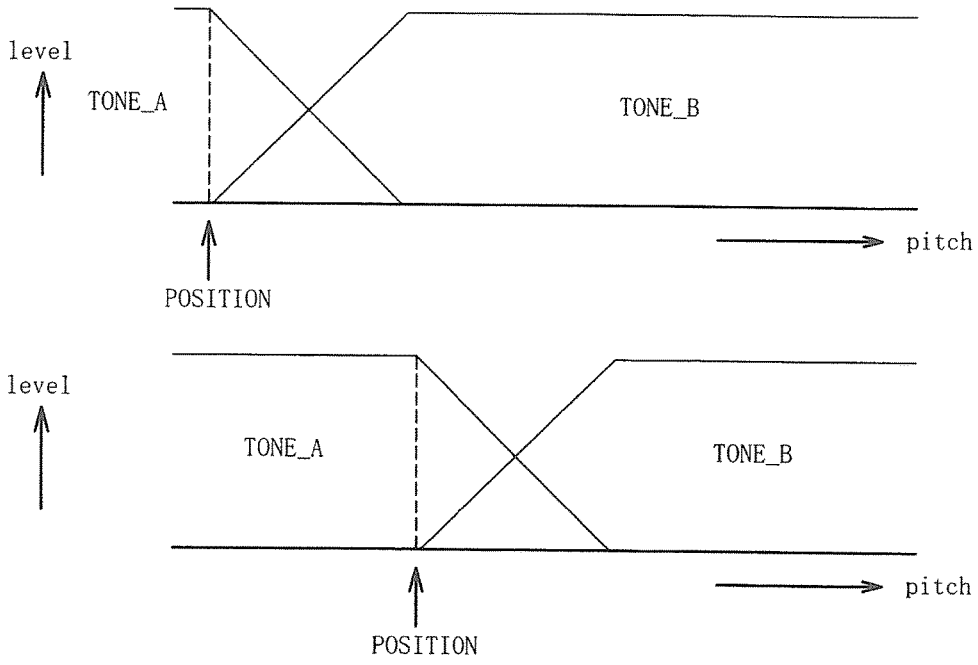
FIG. 14 schematically shows the configuration mode of the parameter information when the operating element LAYER is set to CROSSFADE.

FIG. 14 schematically shows the configuration mode of the parameter information when the LAYER 38 is set to CROSSFADE. When the LAYER 38 is set to CROSSFADE, as shown in FIG. 14, according to the knob position of the POSITION 39, a pitch at which crossfading between the sound having TONE_A and the sound having TONE_B is started varies.

Therefore, in such case, as the wg_A00_level to wg_A48_level (level of each band of TONE_A) and the wg_B00_level to wg_B48_level (level of each band of TONE_B), values within the range of 0.0 to 1.0 are written into the RAM 23, such that a pitch corresponding to the knob position of the POSITION 39 becomes crossfading-characteristic as a start position.

Accordingly, with the pitch corresponding to the knob position of the POSITION 39 as the start position, as the pitch increases, the produced sound gradually switches from TONE_A to TONE_B. Therefore, interest can be added to the produced synthesizer sound and monotonousness can be avoided. Moreover, when the LAYER 38 is set to CROSSFADE, the process executed in step S86 is equivalent to an output control means of the invention.

(2) Periodic Process

Figure 15:
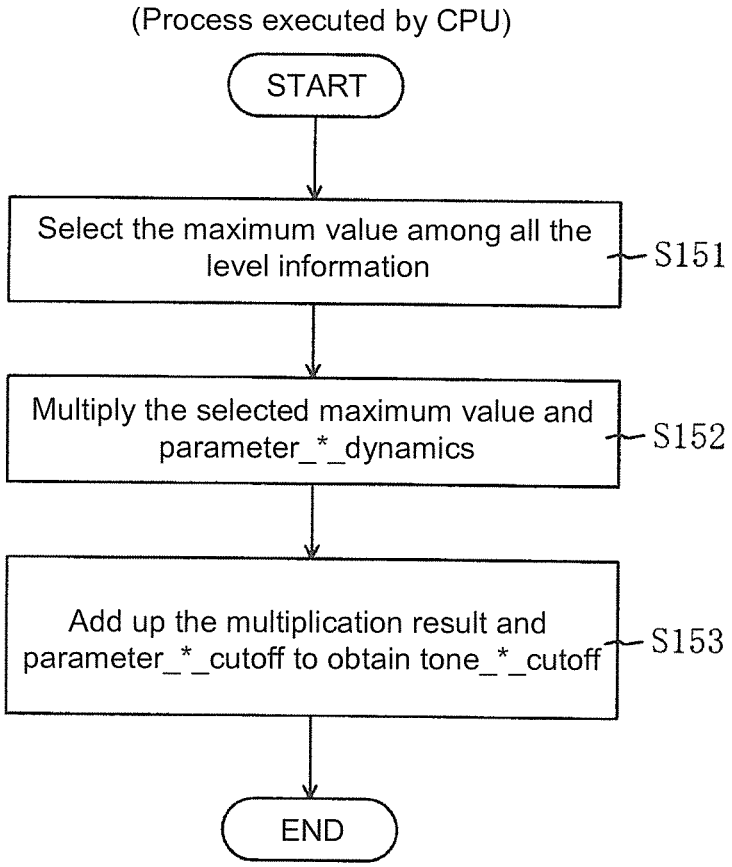
FIG. 15 is a flowchart showing a periodic process executed by the CPU.

FIG. 15 is a flowchart showing the periodic process executed by the CPU 21. In the periodic process, the CPU 21 reads out the level information that was written by the DSP 24 to the RAM 23, so as to control the filter 48. This periodic process is equivalent to a filter characteristic control means of the invention.

As shown in FIG. 15, the CPU 21 selects the maximum value among the level information (i.e., band_level_00 to band_level_48) stored in the RAM 23 (S151). The maximum value selected in step S151 is linked with the amplitude of the input sound. It becomes a large value for an input of a loud sound and becomes a small value for an input of a small sound.

The CPU 21 multiplies the selected maximum value and the parameter_*_dynamics stored in the RAM 23 (S152). This multiplication process is carried out respectively for TONE_A and TONE_B. In other words, the multiplication in step S152 is carried out respectively for the parameter_A_dynamics and the parameter_B_dynamics. The greater the value of the parameter_*_dynamics, the more a multiplication result in step S152 is changed.

The CPU 21 adds up the multiplication result in step S152 and the parameter_*_cutoff stored in the RAM 23 so as to obtain the tone_*_cutoff, and writes the tone_*_cutoff to the RAM 23 (S153). This addition process is carried out respectively for TONE_A and TONE_B. In other words, the addition in step S153 is carried out respectively for the parameter_A_cutoff and the parameter_B_cutoff so as to obtain the tone_A_cutoff and the tone_B_cutoff respectively, and the tone_A_cutoff and the tone_B_cutoff are written to the RAM 23.

The tone_A_cutoff calculated in the periodic process controls the cutoff of the filter 48 for TONE_A (i.e., filter_A). On the other hand, the tone_B_cutoff controls the cutoff of the filter 48 for TONE_B (i.e., filter_B).

According to the periodic process, in the cutoff of the filter 48 for TONE_A, a frequency indicated by the parameter_A_cutoff set by the CUTOFF 34 is regarded as a reference point, and the louder the input sound, the higher the frequency is set. In addition, the greater value the parameter_*_dynamics is set by the DYNAMICS 36, the higher the frequency of the cutoff is set. Moreover, if the value of the parameter_*_dynamics is zero, regardless of the amplitude of the input sound, a fixed cutoff frequency (i.e., the frequency indicated by the parameter_*_cutoff) is set.

According to the processes in steps S151 to S153, the filter characteristics of the filter 48 vary according to the level information of the input sound. Therefore, a synthesizer sound processed according to the level of the input sound can be outputted. Accordingly, the synthesizer sound generated from the input sound can avoid becoming monotonous.

According to the first embodiment, the input sound is divided into a plurality of musical bands by the BPF 42. For each divided band, a waveform having a predetermined shape is generated at the waveform generator 46 with a period corresponding to the pitch detected by the pitch detector 44 and with a level corresponding to the level detected by the level detector 43. The waveforms generated for each band are added up and outputted by the mixer 47.

Therefore, even when only one input sound is inputted, a synthesizer sound corresponding to the timbre of the input sound can be outputted. In other words, by division of the input sound into a plurality of bands, not only fundamental pitch sounds (fundamental tones) but also harmonic components can be detected. Thus, a rich synthesizer sound that reflects the harmonic components contained in the input sound, i.e., reflects the timbre of the input sound, can be outputted.

According to the synthesizer 11 of such configuration, even if the input sound is not a stringed instrument sound such as the above-exemplified guitar sound, but a singing voice (vocal sound), or a sound of a percussion instrument such as a drum or the like or of a keyboard instrument such as a piano or the like, the synthesizer 11 can be utilized, and when these input sounds are inputted, the same effect as that of the aforementioned embodiment can be obtained.

In addition, since the waveform generation level is controlled according to the level of each band in the input sound, the rich (i.e., not monotonous) level variation inherent in the input sound can be reflected in the synthesizer sound. In this respect, a rich synthesizer sound can be outputted.

Furthermore, since the waveform generation level is controlled according to the level of each band in the input sound, there is no need to perform a sound production control using gate detection as in the prior art. Accordingly, the problems caused by the gate detection can be avoided, and the synthesizer sound that complies with the intention of the input sound can be outputted.

In addition, since the input sound is divided into a plurality of bands so as to obtain the synthesizer sound for the input sound, a polyphonic guitar synthesizer can be realized without installing a pickup corresponding to each string. In addition, there is no need to change the processing configuration according to the number of strings or the type of the stringed instrument, and a program does not change according to difference in the number of strings. Therefore, the synthesizer 11 of this embodiment can be utilized independently of the number of strings or the type of the stringed instrument such as a guitar or a bass.

In addition, according to the synthesizer 11 of this embodiment, the period of the waveform generated by the waveform generator 46 is controlled to be a period corresponding to a value obtained by adding the pitch shift amount set by operating the PITCH 33 to the pitch detected by the pitch detector 44 of the corresponding band. Therefore, since the synthesizer sound generated from the input sound can be given variety corresponding to the pitch shift amount, the synthesizer sound can avoid becoming monotonous.

Next, a second embodiment of the invention is described with reference to FIGS. 16 to 19. In this embodiment, the output (level information) from the level detector 43 is processed. In the second embodiment, the same reference numerals denote the same portions as those in the first embodiment, and descriptions thereof are omitted.

Figure 16:
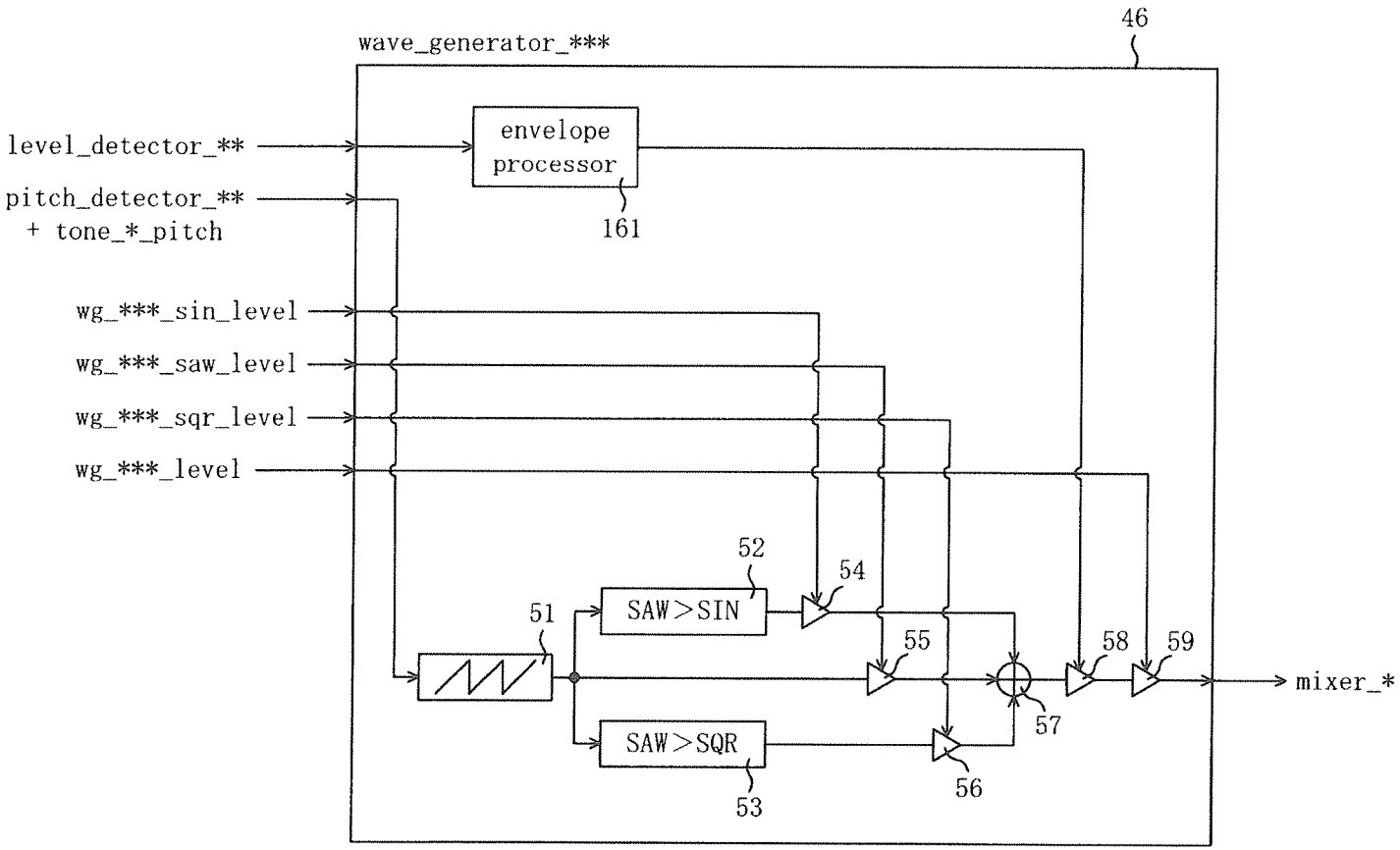
FIG. 16 is a block diagram for illustrating the waveform generator of a second embodiment.

FIG. 16 is a block diagram for illustrating the waveform generator 46 of the second embodiment. The waveform generator 46 of the second embodiment includes, in addition to the waveform generator 46 of the first embodiment, an envelope processor 161. In this embodiment, the multiplier 58 and the envelope processor 161 are equivalent to a waveform level control means of the invention. Moreover, the waveform generators 46 of this embodiment, i.e., the wave_generator_A00 to wave_generator_A48 and the wave_generator_B00 to wave_generator_B48, all have the same configuration.

Figure 17:
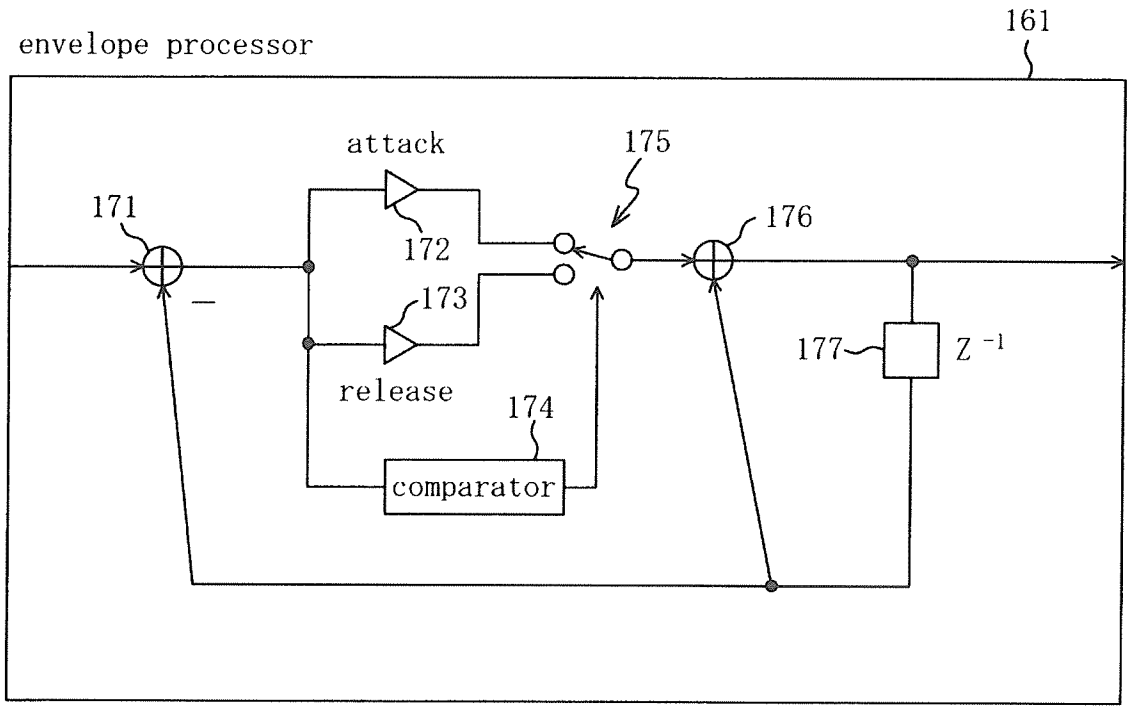
FIG. 17 is a block diagram for illustrating an envelope processor.

FIG. 17 is a block diagram for illustrating the envelope processor 161. An adder 171 obtains a difference between a level signal outputted from the level detector 43 and an output of a one-sample delay element ($Z^{-1}$) 177.

A comparator 174 determines whether the output of the adder 171 is zero or greater, or negative. The DSP 24 drives a switch 175 to select a multiplier 172 that multiplies attack if the comparison result performed by the comparator 174 is zero or greater, and to select a multiplier 173 that multiplies release if the comparison result is negative.

The attack is a multiplier factor by which the output of the adder 171 (i.e., the difference between the level signal outputted from the level detector 43 and the output of the one-sample delay element 177) is multiplied. The attack is a value in the range of 0.0 to 1.0. The value of the attack is variable within the above range according to the state of the operating elements provided on the panel 25. According to the value of the attack, a rising speed of the level variation obtained by processing is determined.

The release is also a multiplier factor by which the output of the adder 171 is multiplied. The release is a value in the range of 0.0 to 1.0. The value of the release is variable within the above range according to the state of the operating elements provided on the panel 25. According to the value of the release, an attenuation speed of the level variation obtained by processing is determined. An adder 176 adds up a numerical value selected by the switch 175 and the output of the one-sample delay element 177. An output of the adder 176 is used as an output of the envelope processor 161 and is inputted to the one-sample delay element 177.

Figure 18:
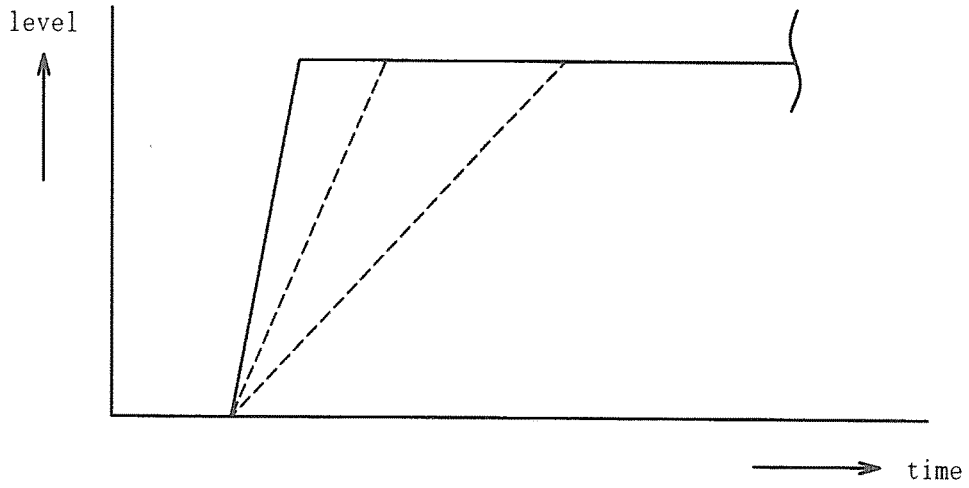
FIG. 18 shows effects of a multiplier factor attack.

FIG. 18 shows effects of the multiplier factor attack. The solid line indicates the level information inputted to the envelope processor 161, while the broken lines indicate the level information processed by the envelope processor 161. The smaller the value of the attack, the slower the rise in the level variation. Therefore, in a configuration that allows the value of the attack to be set by panel operation, the mode of the rise of the synthesizer sound can be adjusted through panel operation.

Figure 19:
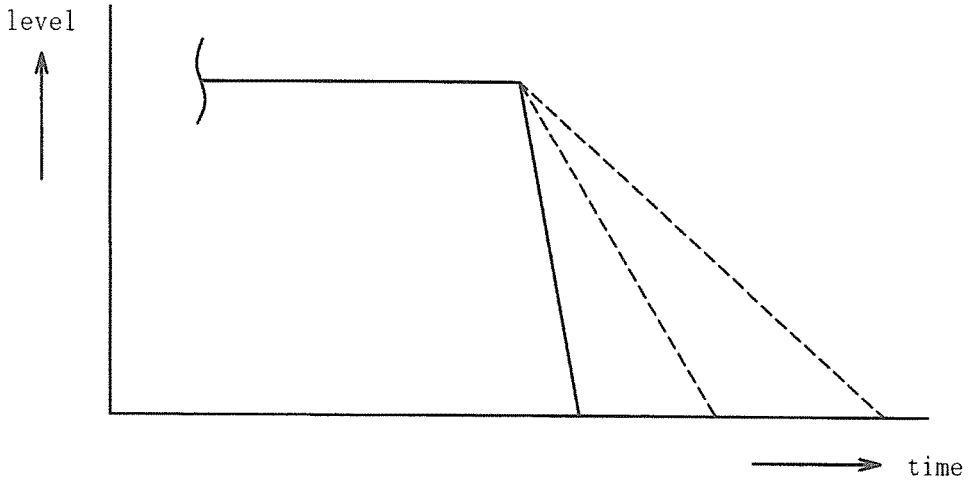
FIG. 19 shows effects of a multiplier factor release.

FIG. 19 shows effects of the multiplier factor release. The solid line indicates the level information inputted to the envelope processor 161, while the broken lines indicate the level information processed by the envelope processor 161. The smaller the value of the release, the slower the attenuation in the level. Therefore, in a configuration that allows the value of the release to be set by panel operation, the mode of the attenuation of the synthesizer sound can be adjusted through panel operation.

According to the second embodiment, the mode of rise or attenuation of the synthesizer sound can be changed by processing the level information using the envelope processor 161. As a result, in contrast to a rapid rise in the amplitude of the input sound, by processing the level information to cause the level information to gradually rise, variety can be given to the synthesizer sound generated from the same input sound, such as a slowed increase in the synthesizer sound, and so on. Accordingly, the synthesizer sound can avoid becoming monotonous.

Next, a third embodiment of the invention is described with reference to FIG. 20. In the first embodiment, the pitch of the synthesizer sound is determined based on the output (pitch information) from the pitch detector 44 and the pitch shift amount (tone_*_pitch) set by the operation on the PITCH 33. Regarding this, in the third embodiment, a mechanism for changing the pitch is further provided.

For example, a low-frequency oscillator 201 (hereinafter "LFO 201") that oscillates about zero and generates a periodic signal having a relatively low frequency (to an extent of several 10 Hz) is used, and by addition of a value outputted by the LFO 201, the pitch of the synthesizer sound can be controlled.

Figure 20:
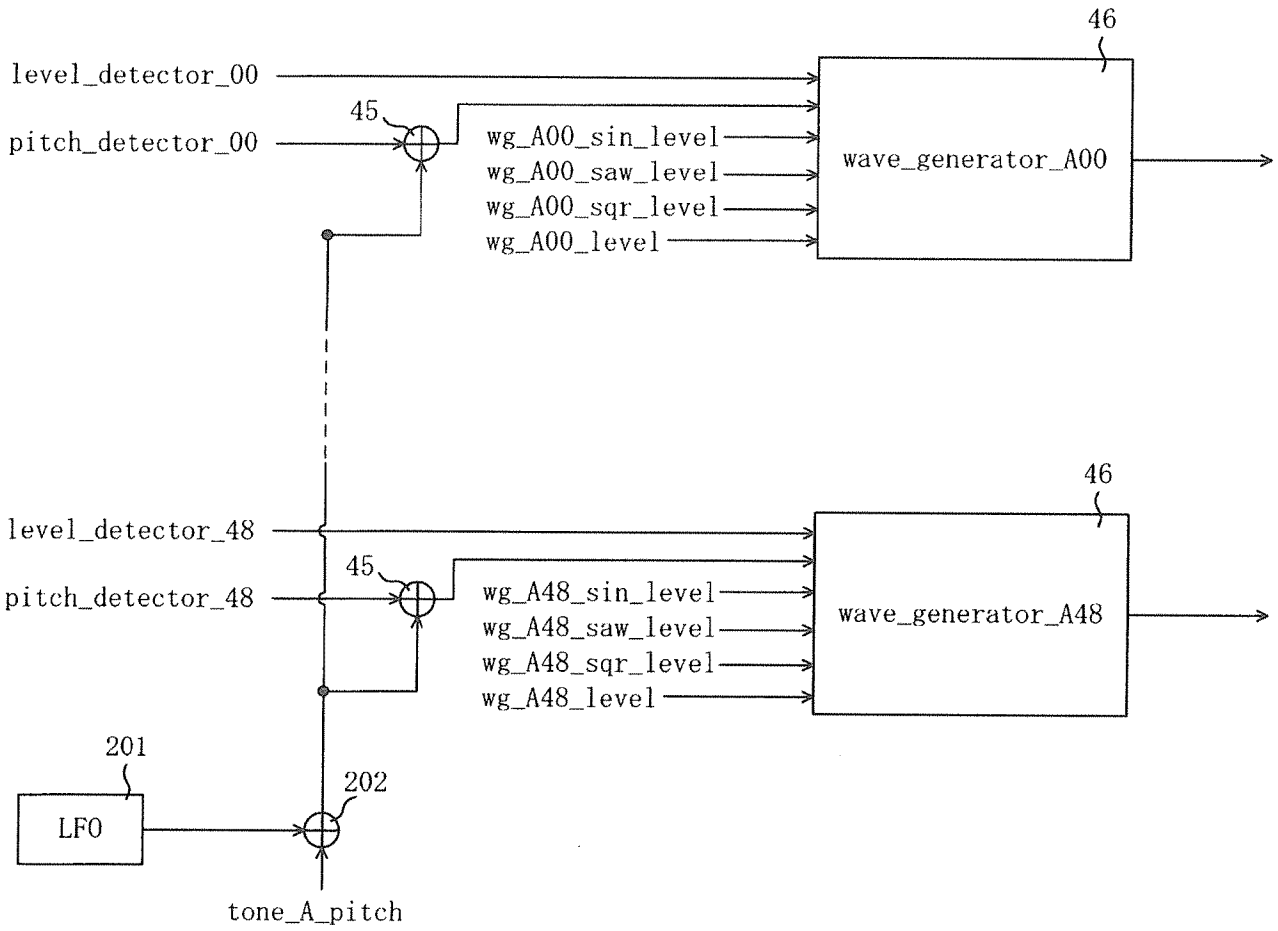
FIG. 20 is a block diagram for illustrating a configuration of a third embodiment.
Figure 21:
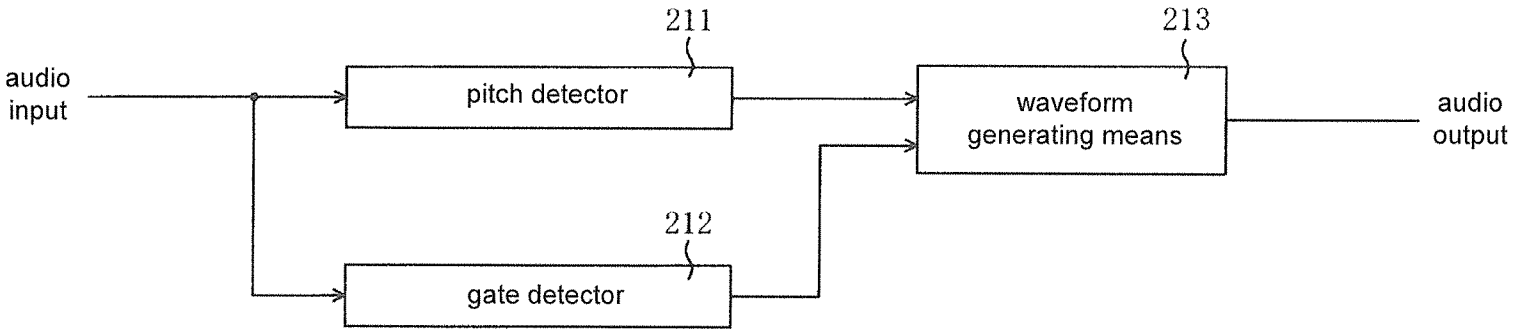
FIG. 21 is a block diagram showing a configuration of a conventional synthesizer.
Figure 22:
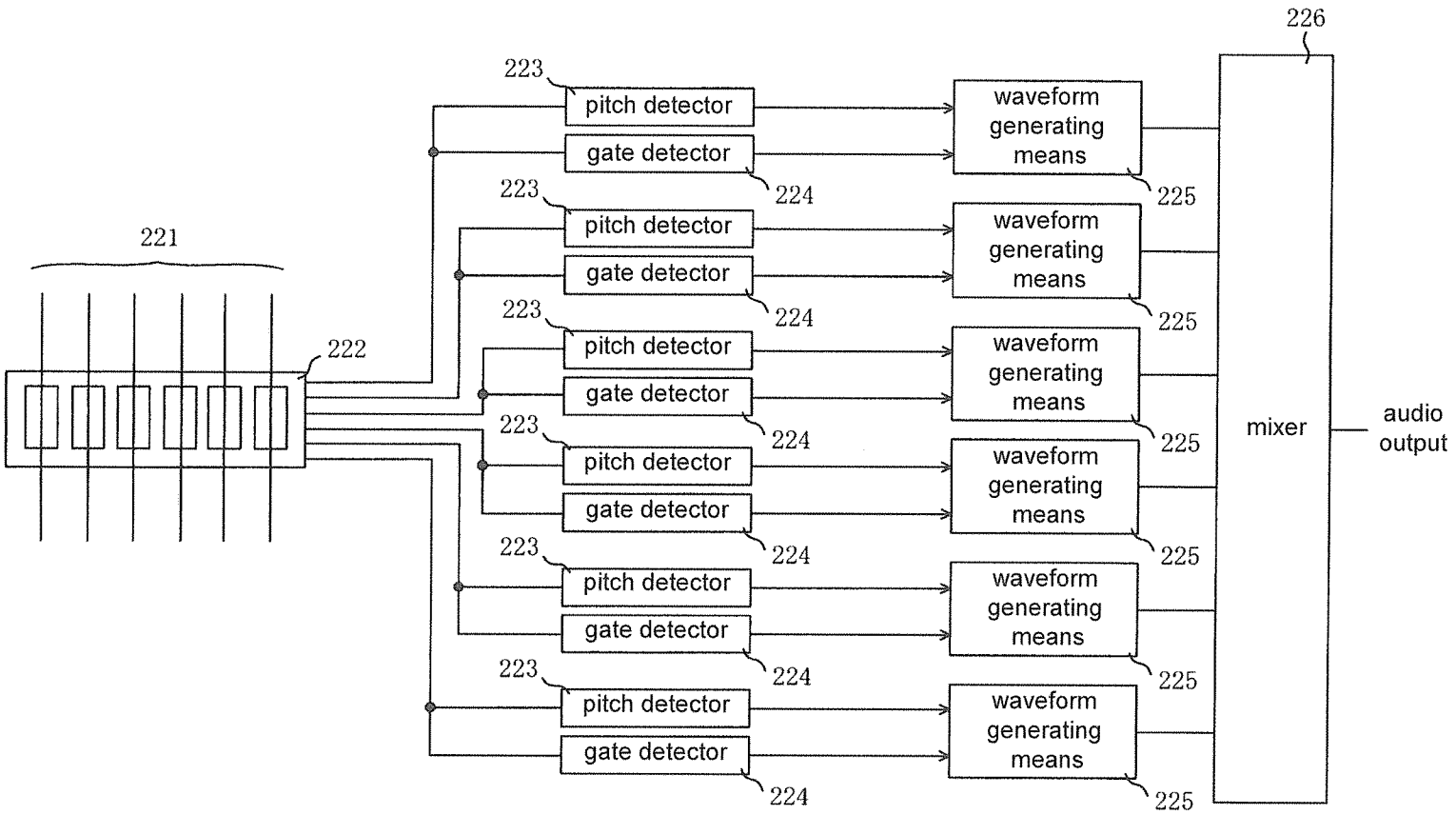
FIG. 22 is a block diagram showing a configuration of a conventional synthesizer.
Figure 23:
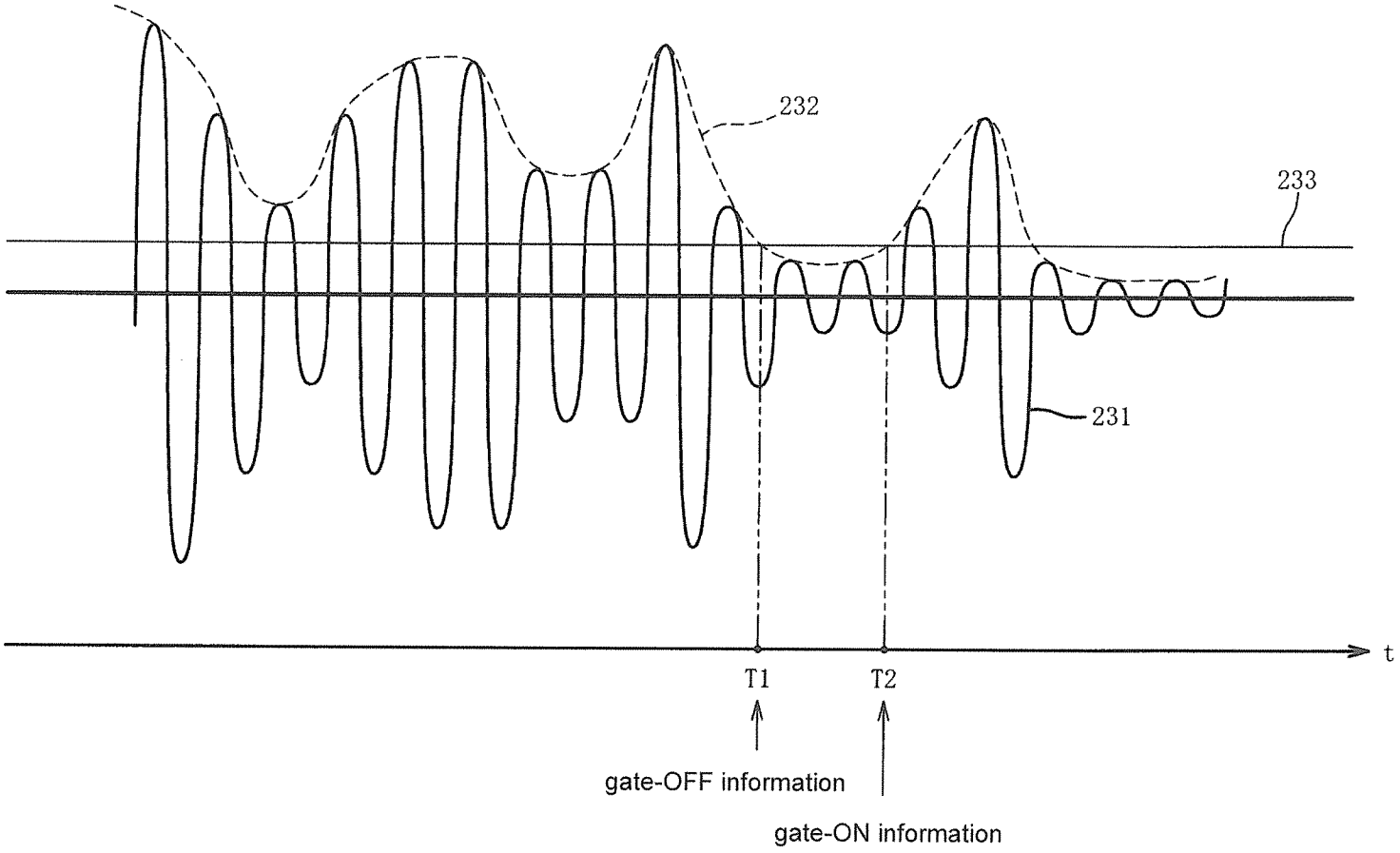
FIG. 23 shows an example of erroneous detection performed by the gate detector.
Figure 24A:
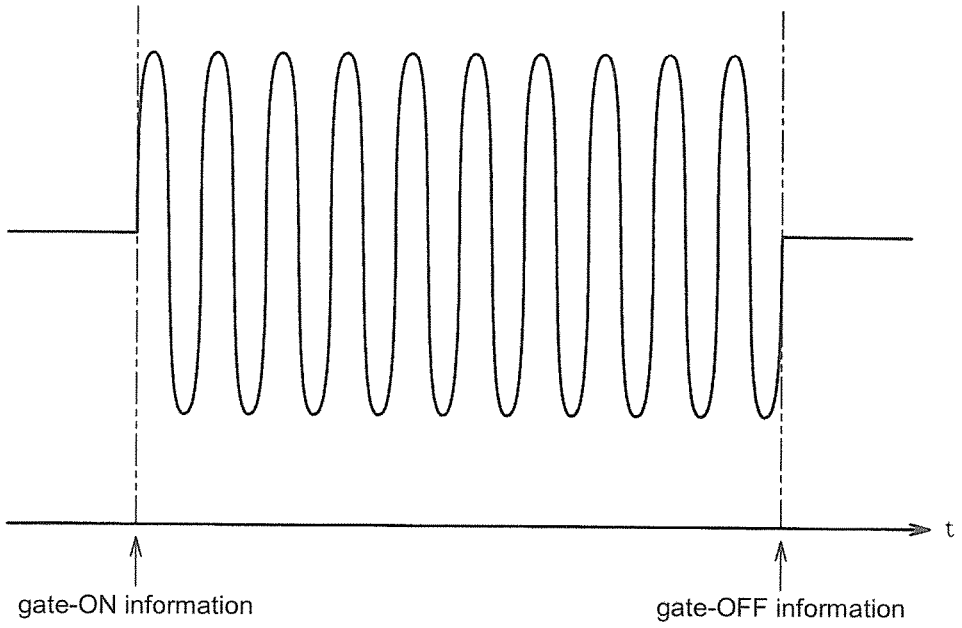
FIGS. 24A and 24B illustrate problems in a sound production control using gate-ON information and gate-OFF information.
Figure 24B:
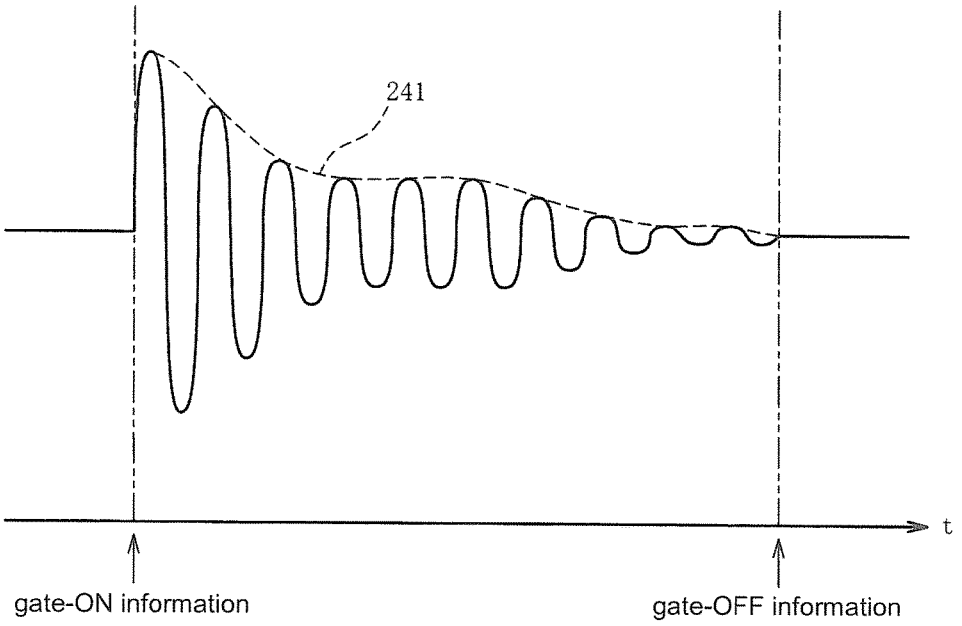

FIG. 20 is a block diagram for illustrating a configuration of the third embodiment. The control of TONE_A is exemplified in FIG. 20, and the same control applies to TONE_B. The synthesizer 11 of this embodiment includes the LFO 201. The LFO 201 is equivalent to a periodic signal output means of the invention. An adder 202 adds a value outputted by the LFO 201 to the value of the tone_A_pitch. The addition result is added to the output (pitch information) from the pitch detector 44 by the adder 45 for TONE_A corresponding to each BPF 42 and a result thereof is outputted to the waveform generator 46. Moreover, the above description may apply to the control of TONE_B if "A" is replaced with "B."

According to the third embodiment, the pitch of the synthesizer sound can be periodically shifted up and down according to the periodic signal outputted by the LFO 201. Therefore, a vibrato effect can be imparted to the synthesizer sound. Accordingly, the synthesizer sound generated from the input sound can avoid becoming monotonous.

The above illustrates the invention on the basis of the embodiments. However, it is easily understood that the invention is not limited to any of the above embodiments, and various modifications or alterations may be made without departing from the spirit of the invention.

For example, the numerical values mentioned in the above embodiments are merely examples, and it is of course possible that other numerical values are suitably used. For example, in the above embodiments, the number of the BPF 42 is forty-nine. However, the number is not limited thereto and may be any suitable number.

In the above embodiments, two types of instruments including a guitar and a bass have been exemplified as the instrument that can utilize the synthesizer 11, i.e., the instrument that can be specified by the INSTRUMENT 31. However, the invention is not limited thereto. There may be three or more types of instruments that can be specified by the INSTRUMENT 31. In addition, the synthesizer 11 may be configured to utilize a specific instrument.

In the above embodiments, the user manually operates the INSTRUMENT 31, and the synthesizer 11 is configured to identify whether the input sound is a guitar sound or a bass sound according to the specification of the INSTRUMENT 31. Alternatively, the synthesizer 11 may be configured to automatically determine the type of the instrument based on the input sound.

In the above embodiments, two types of instruments including a guitar and a bass have been exemplified as the instrument that can utilize the synthesizer 11. However, instruments other than guitars and basses can also be used. In other words, the input sound of the synthesizer 11 is not limited to a stringed instrument sound such as the above-exemplified guitar sound and so on, but may also be a singing voice (vocal sound), or a sound of a percussion instrument such as a drum or the like or of a wind instrument such as a saxophone or a trumpet or the like or of a keyboard instrument such as a piano or the like.

In addition, the stringed instrument that can utilize the synthesizer 11 is not limited to the above-exemplified guitar or bass, but may also be any other stringed instrument such as a violin or an erhu. In addition, the synthesizer 11 can be utilized in the same type of stringed instrument in the same manner without depending on difference in the number of strings. In other words, for example, a six-string guitar and a seven-string guitar can utilize the synthesizer 11 in the same manner.

In the above embodiments, forty-nine BPFs 42 are provided and the sound range processed by these BPFs 42 are set to match the sound range of the instrument specified by the INSTRUMENT 31. However, a configuration in which a large number of BPFs 42 capable of covering a wide frequency range are provided in order to comprehensively cope with various instruments is also suitable. In addition, in the above embodiments, all the forty-nine BPFs 42 are used to divide the input sound into forty-nine bands. However, according to the type of the instrument, the input sound may be divided into bands using only a part of the forty-nine BPFs 42.

In the above embodiments, the center frequencies respectively set for a plurality of BPFs 42 are used as semitones of musical bands. However, the disclosure is not limited to semitone. As long as a musical frequency range (e.g., a frequency range on an octave basis) defined by a predetermined highest frequency and a predetermined lowest frequency can be divided into musical units, various types of bands can be utilized. For example, a musical frequency range of four octaves or five octaves may be divided in units of one octave.

In the above embodiments, in step S151 in the periodic process, the CPU 21 selects the maximum value of the level information stored in the RAM 23. However, instead of selecting the maximum value, the CPU 21 may calculate a sum value of the level information or an average value thereof. Moreover, by obtaining the maximum value of the level information, a difference between values obtained in the circumstance that the input sound is a single note and in the circumstance that the input sound is a chord is little (i.e., the value will not be too large even in the circumstance that a chord is performed), and thus the cutoff frequency can be controlled in a preferable range for any performance.

In the above embodiments, the parameter information corresponding to the state of the various operating elements, such as the parameter information corresponding to the switch position of the INSTRUMENT 31, is stored in the ROM 22. However, it may also be stored in a rewritable nonvolatile memory such as a flash memory. If the various parameter information is stored in a flash memory or the like, the parameter information may be properly added, modified or deleted.

In the above embodiments, the RAM 23 functions as the working area of the CPU 21 and as the interface for transferring data between the CPU 21 and the DSP 24. Alternatively, the RAM utilized for the working area of the CPU 21 and the RAM functioning as the interface for transferring data between the CPU 21 and the DSP 24 may be separately provided.

The features described according to the first, second and third embodiments or the aforementioned variants may also be implemented in proper combination.

What is claimed is:

1. A synthesizer, comprising:

a band dividing means that divides an input sound into a plurality of musical bands;

a pitch detecting means that, for each of the bands divided by the band dividing means, detects a pitch of a signal of the each of the bands;

a level detecting means that, for each of the bands divided by the band dividing means, detects a level of the signal of the each of the bands;

a waveform generating means that, for each of the bands divided by the band dividing means, generates a waveform having a predetermined shape according to the signal of the each of the bands;

a waveform period control means that, for each of the bands divided by the band dividing means, controls a period of the waveform generated by the waveform generating means corresponding to the each of the bands to be a period corresponding to the pitch detected by the pitch detecting means corresponding to the each of the bands;

a waveform level control means that, for each of the bands divided by the band dividing means, controls a level of the waveform generated by the waveform generating means corresponding to the each of the bands to be a level corresponding to the level detected by the level detecting means corresponding to the each of the bands;

an adding means that adds up the waveform is generated by each of the waveform generating means corresponding to each of the bands divided by the band dividing means and outputs a result thereof; and a pitch shift amount setting means that sets a pitch shift amount, wherein the waveform period control means controls the period of the waveform generated by the waveform generating means corresponding to each of the bands to be a period corresponding to a value obtained by adding the pitch shift amount set by the pitch shift amount setting means to the pitch detected by the pitch detecting means corresponding to the each of the bands.

2. The synthesizer according to claim 1, wherein the musical bands are bands obtained by dividing a musical frequency range comprising a predetermined highest frequency and a predetermined lowest frequency in musical units.

3. The synthesizer according to claim 2, wherein the musical frequency range is a frequency range on an octave basis.

4. The synthesizer according to claim 2, wherein the musical frequency range is a frequency range corresponding to a type of the input sound.

5. The synthesizer according to claim 1, wherein the musical bands are semitone bands.

6. The synthesizer according to claim 1, comprising a waveform shape setting means that sets a waveform having one of a plurality of types of shapes as the waveform having the predetermined shape.

7. The synthesizer according to claim 1, comprising a waveform shape setting means that sets waveforms of a plurality of types of different shapes as the waveform having a predetermined shape and sets each of the waveforms to each of the bands divided by the band dividing means.

8. The synthesizer according to claim 1, comprising:

a filter means that performs a filter process to the waveform obtained through an addition performed by the adding means and outputs a result thereof; and a filter characteristic control means that changes filter characteristics used in the filter process based on the level detected by the level detecting means corresponding to each of the bands.

9. The synthesizer according to claim 1, comprising a periodic signal output means that outputs a low-frequency periodic signal, wherein the waveform period control means controls the period of the waveform generated by the waveform generating means corresponding to each of the bands to be a period corresponding to a value obtained by adding the low-frequency periodic signal outputted from the periodic signal output means to the pitch detected by the pitch detecting means corresponding to the each of the bands.

10. The synthesizer according to claim 1, wherein the waveform level control means changes a variation mode of rise or attenuation of the level of the waveform generated by the waveform generating means corresponding to each of the bands, by processing the level detected by the level detecting means corresponding to the each of the bands.

11. The synthesizer according to claim 10, wherein the waveform level control means changes the variation mode of rise or attenuation of the level of the waveform generated by the waveform generating means corresponding to each of the bands, based on a value obtained by multiplying a time-series differential value of the level detected by the level detecting means corresponding to the each of the bands by a predetermined coefficient.

12. The synthesizer according to claim 11, wherein the waveform level control means determines whether the level rises or attenuates according to the time-series differential value of the level detected by the level detecting means corresponding to each of the bands, and when determining that the level rises, changes the variation mode of rise of the level of the waveform generated by the waveform generating means corresponding to the each of the bands, and when determining that the level attenuates, changes the variation mode of attenuation of the level of the waveform generated by the waveform generating means corresponding to the each of the bands.

13. The synthesizer according to claim 1, wherein the waveform generating means comprises:

a first waveform generating means that, for each of the bands divided by the band dividing means, generates a first waveform having a first predetermined shape corresponding to the signal of the each of the bands; and a second waveform generating means that, for each of the bands divided by the band dividing means, generates a second waveform having a second predetermined shape corresponding to the signal of the each of the bands, and the adding means comprises:

a first adding means that adds up the first waveforms generated by each of the first waveform generating means corresponding to each of the bands divided by the band dividing means and outputs a result thereof; and a second adding means that adds up the second waveforms generated by each of the second waveform generating means corresponding to each of the bands divided by the band dividing means and outputs a result thereof, and the synthesizer comprises an output control means that, for the input sound having a pitch between a first pitch and a second pitch greater than the first pitch, controls the first waveform being added that is outputted by the first adding means and the second waveform being added that is outputted by the second adding means, from the first pitch to the second pitch, to gradually switch from the first waveform being added to the second wave form being added.

14. The synthesizer according to claim 1, wherein the waveform generating means comprises:

a first waveform generating means that, for each of the bands divided by the band dividing means, generates a first waveform having a first predetermined shape corresponding to the signal of the each of the bands; and a second waveform generating means that, for each of the bands divided by the band dividing means, generates a second waveform having a second predetermined shape corresponding to the signal of the each of the bands, and the adding means comprises:

a first adding means that adds up the first waveforms generated by each of the first waveform generating means corresponding to each of the bands divided by the band dividing means and outputs a result thereof; and a second adding means that adds up the second waveforms generated by each of the second waveform generating means corresponding to each of the bands divided by the band dividing means and outputs a result thereof, and the adding means adds up the first waveform being added that is outputted by the first adding means and the second waveform being added that is outputted by the second adding means and outputs a result thereof.

15. The synthesizer according to claim 1, comprising:

a memory means that stores a plurality of types of band division information defining a mode of dividing the plurality of musical bands;

a band division information specifying means that specifies one of the plurality of types of band division information stored in the memory means; and a band setting means that reads out the band division information specified by the band division information specifying means from the memory means and sets a mode of the band dividing means dividing the input sound into the plurality of musical bands based on the read-out band division information.

16. The synthesizer according to claim 15, wherein the memory means stores a plurality of the band division information corresponding to a plurality of types of instruments; and the band division information specifying means specifies the band division information by specifying one of the plurality of types of instruments.

* * * * *